US009080374B2

(12) United States Patent
Gavish

(10) Patent No.: US 9,080,374 B2
(45) Date of Patent: Jul. 14, 2015

(54) SHELTERING DEVICE

(71) Applicant: Nadav Gavish, Tel Aviv (IL)

(72) Inventor: Nadav Gavish, Tel Aviv (IL)

( * ) Notice: Subject to any disclaimer, the term of this patent is extended or adjusted under 35 U.S.C. 154(b) by 49 days.

(21) Appl. No.: 13/733,359

(22) Filed: Jan. 3, 2013

(65) Prior Publication Data

US 2013/0118696 A1 May 16, 2013

Related U.S. Application Data

(63) Continuation-in-part of application No. PCT/IL2011/000536, filed on Jul. 7, 2011.

(60) Provisional application No. 61/362,350, filed on Jul. 8, 2010.

(51) Int. Cl.
*E04F 10/06* (2006.01)
*E06B 9/24* (2006.01)

(52) U.S. Cl.
CPC ..... *E06B 9/24* (2013.01); *E04F 10/0603* (2013.01); *E04F 10/0618* (2013.01); *E04F 10/0629* (2013.01); *E04F 10/0648* (2013.01); *E04F 10/0651* (2013.01); *E04F 10/0688* (2013.01)

(58) Field of Classification Search
CPC ..... E04F 10/0603; E04F 10/0618; E04F 10/0629; E04F 10/0651; E04F 10/0688; E04F 10/0648
USPC ..... 160/66, 68, 69, 78, 64, 84.09, 84.11, 160/265, 263, 84.07, 134, 71; 135/88.01
See application file for complete search history.

(56) References Cited

U.S. PATENT DOCUMENTS

| | | | | |
|---|---|---|---|---|
| 934,605 | A | 9/1909 | Goudie et al. | |
| 1,594,643 | A * | 8/1926 | Stuart | 160/68 |
| 1,749,197 | A * | 3/1930 | Stuart | 160/68 |
| 2,679,255 | A | 5/1954 | Stafford | |
| 2,772,684 | A | 12/1956 | Puls et al. | |
| 3,216,433 | A | 11/1965 | Azzo | |
| 4,171,013 | A | 10/1979 | Clark | |
| 4,214,621 | A | 7/1980 | Wessels et al. | |
| 4,262,373 | A * | 4/1981 | Chambers | 4/502 |

(Continued)

FOREIGN PATENT DOCUMENTS

| | | | |
|---|---|---|---|
| CN | 2869189 | Y | 7/2007 |
| DE | 19725892 | B4 | 4/2006 |

(Continued)

*Primary Examiner* — Katherine Mitchell
*Assistant Examiner* — Scott Denion
(74) *Attorney, Agent, or Firm* — Browdy and Neimark, PLLC

(57) ABSTRACT

A sheltering device configured for being installed over a designated object such as a vehicle's roof. The sheltering device includes: a single flexible cover having a shape of varying width; foldable supporting arms, attachable to the cover; and a retractable mechanism configured for folding and unfolding the foldable supporting arms for folding and unfolding the cover. The foldable supporting arms are configured to simultaneously move along predefined non-parallel trajectories when unfolding, to allow the flexible cover, attached thereto, to unfold in a forward and sideways movement throughout the unfolding movement, while creating two (or more) stable supporting points suspended in air at its distal edges and/or along the bars, which provide tension to the cover attached in all required direction, thus eliminating the necessity of using a ridged connection between these distal edges.

20 Claims, 24 Drawing Sheets

(56) References Cited

U.S. PATENT DOCUMENTS

| | | | | |
|---|---|---|---|---|
| 4,834,446 | A | 5/1989 | Tung-Chow | |
| 4,997,021 | A | 3/1991 | Brutsaert | |
| 5,273,095 | A * | 12/1993 | Lukos | 160/70 |
| 5,400,813 | A | 3/1995 | Swan, Jr. | |
| 5,551,465 | A | 9/1996 | Steiner | |
| 5,558,145 | A | 9/1996 | Baka | |
| 5,579,820 | A | 12/1996 | LePage et al. | |
| 5,752,560 | A * | 5/1998 | Cherng | 160/370.22 |
| 6,035,874 | A | 3/2000 | Po-Chang | |
| 6,086,133 | A * | 7/2000 | Alonso | 296/97.8 |
| 6,179,367 | B1 | 1/2001 | Bowen | |
| 6,332,290 | B1 | 12/2001 | Delamare | |
| 6,457,508 | B1 * | 10/2002 | Tomita | 160/67 |
| 6,782,904 | B2 * | 8/2004 | Tien | 135/88.07 |
| 6,971,433 | B2 * | 12/2005 | Wagner et al. | 160/67 |
| 8,844,640 | B2 * | 9/2014 | Linares | 169/48 |
| 2002/0069980 | A1 | 6/2002 | Floyd | |
| 2004/0084072 | A1 * | 5/2004 | Tien | 135/88.07 |
| 2004/0159407 | A1 | 8/2004 | Girard et al. | |
| 2004/0261953 | A1 | 12/2004 | Hart | |
| 2005/0016692 | A1 | 1/2005 | Glaser et al. | |
| 2005/0206181 | A1 | 9/2005 | Sagi et al. | |
| 2007/0113988 | A1 | 5/2007 | Thompson et al. | |
| 2007/0246168 | A1 | 10/2007 | Ito | |
| 2008/0053624 | A1 | 3/2008 | Ito | |
| 2008/0277073 | A1 | 11/2008 | Ito | |
| 2008/0308238 | A1 | 12/2008 | Ito | |
| 2009/0050277 | A1 | 2/2009 | Ito | |
| 2010/0126544 | A1 * | 5/2010 | Wagner et al. | 135/117 |

FOREIGN PATENT DOCUMENTS

| | | | |
|---|---|---|---|
| GB | 1380412 | A | 1/1975 |
| JP | 10292675 | A1 | 4/1998 |
| JP | 2008215072 | A | 9/2008 |
| WO | 03035995 | A | 5/2003 |

* cited by examiner

SHELTERING DEVICE

CROSS-REFERENCE TO RELATED PATENT APPLICATIONS

This application is a Continuation in Part of PCT application No. PCT/IL2011/000536 filed on Jul. 7, 2011, which claims priority to Provisional patent application No. 61/362,350 filed on Jul. 8, 2010, both of which are incorporated herein by reference in their entirety.

FIELD OF THE INVENTION

The present invention relates to the field of sheltering devices, and more particularly, to retractable sheltering devices.

BACKGROUND OF THE INVENTION

Various structures of awning devices are known in the art. Most of the awning devices are designed for stores, providing shelter in front of them such as disclosed in the following applications and patents: US applications US2009050277A, US2007113988A, US2008053624A, US2008277073A, US2007246168A Chinese application CN2869189Y, German application No. DE19725892A and Japanese application No. JP2008215072. These devices are mostly manual and provide shelter only at narrow area nearby the structure.

Various vehicle awnings have been provided in prior art such as US applications and patents: US2005206181A, US2004159407A, U.S. Pat. No. 6,035,874, U.S. Pat. No. 5,558,145A, U.S. Pat. No. 5,400,813, U.S. Pat. No. 4,997,021A, U.S. Pat. No. 2,679,255, International application No. WO03035995A, Japanese application No. JP10292675A and British application No. GB1380412. Most of the devices disclosed in prior art require supporting legs or otherwise provide small sheltering area near by the vehicle.

BRIEF DESCRIPTION OF THE DRAWINGS

The present invention will be more readily understood from the detailed description of embodiments thereof made in conjunction with the accompanying drawings of which.

SUMMARY OF THE INVENTION

Figure 1:
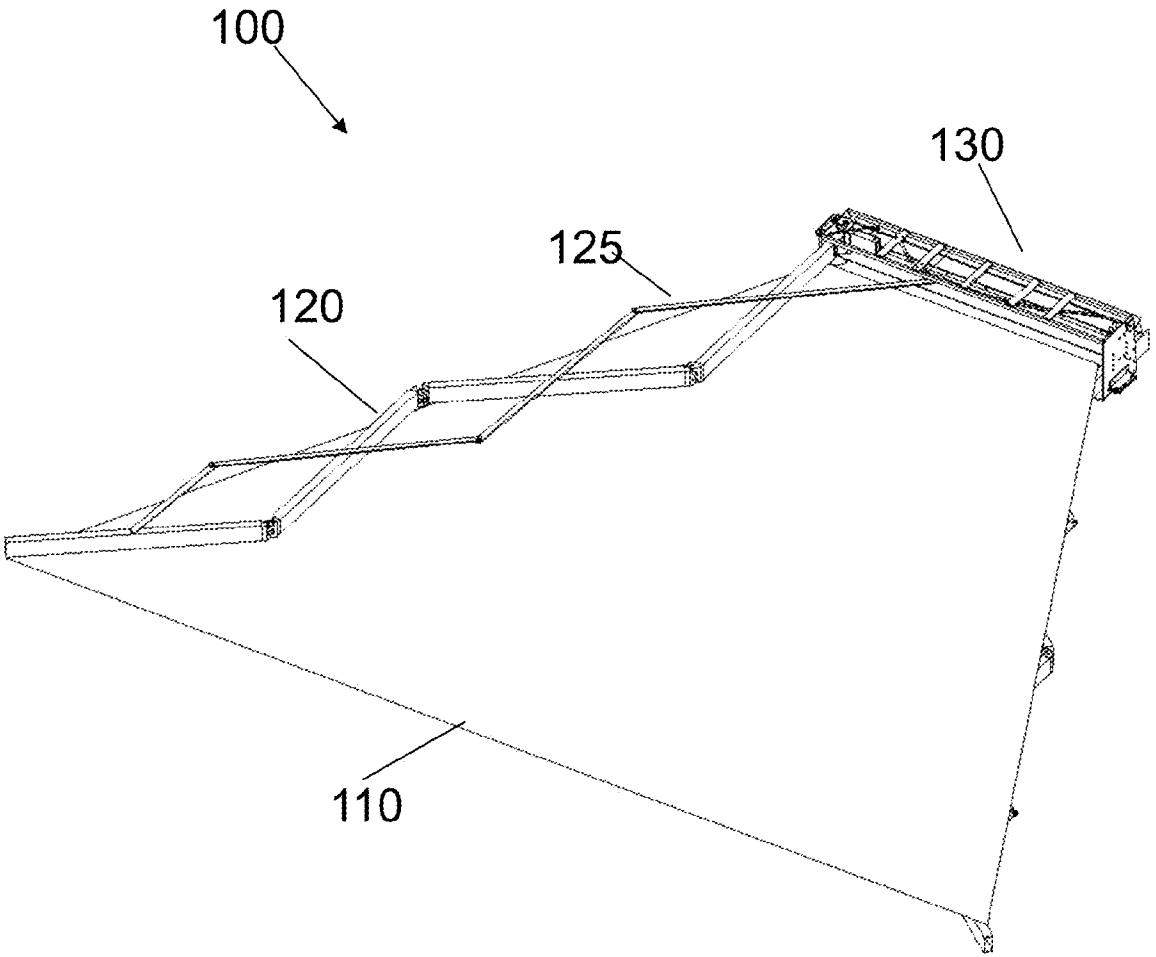
FIG. 1 illustrates a sheltering device in an open position according to some embodiments a first embodiment of the present invention.

The present invention, in some embodiments thereof, discloses a sheltering device configured for being installed over a designated object such as a vehicle's roof, wherein the sheltering device includes: a single flexible cover having a shape of varying width; foldable supporting arms, attachable to the cover; and a retractable mechanism configured for folding and unfolding the foldable supporting arms for folding and unfolding the cover. The foldable supporting arms are configured to simultaneously move along predefined non-parallel trajectories when unfolding, to allow the flexible cover, attached thereto, to unfold in a forward and sideways movement throughout the unfolding movement, while creating two or more stable supporting points suspended in air at its distal edges and/or along the bars, which provide tension to the cover attached in all required direction, thus eliminating the necessity of using a ridged connection between these distal edges Optionally, the foldable supporting arms are constructed of at least two sets of interconnected bars. The bars-sets at the open position may optionally construct a zigzag shape intersecting each other, wherein each two intersecting bars of each different set are pivotally connected through a hinge.

Additionally or alternatively, the sheltering device further includes one or more curved bars connected to one set of bars of the supporting arms, wherein the bars slides along the curve bars while expanding, hence the movement of the supporting arms edges is two dimensional and is restricted by the curved bars form.

Optionally, one or more bar in each set is hollow, encapsulating at least one spring which in its normal position tends to unfold the bar and stretch the cover forwards and sideways.

According to some embodiments of the invention, the retractable mechanism includes a transmission mechanism for operating the retractable mechanism, wherein the transmission mechanism comprises at least one of: a motor configured for electrically operating said sheltering device for folding and unfolding thereof by folding and unfolding said supporting arms and/or a handle for manually operating the retractable mechanism. The retractable mechanism may also further include a mounting encapsulating the supporting arms, a roller, the electronic motor and cover in its closed position.

The retractable mechanism may optionally also include at least one electric motor arranged for operating the roller and move the set of supporting arms forward and backward.

The supporting arms may have a telescopic structure comprised of plural pipes elements.

The trajectories of said supporting arms through the folding and unfolding movement thereof may be curved or straight and also may be crossing or uncrossing.

The retractable mechanism optionally includes a pneumatic or hydraulic mechanism for folding and unfolding of said supporting arms for closing and opening, respectively, of said flexible cover.

According to some embodiments of the invention, the supporting arms are positioned one above the other.

Additionally or alternatively, the supporting arms are positioned at the same height level, one beside the other.

According to optional embodiments, the flexible cover includes one or more inflatable elements and a pneumatic compressor for inflating and deflating the inflatable elements for unfolding and folding of the flexible cover.

Optionally, each of the supporting arms comprises a first and a second bar set having multiple bars intersecting one another forming a zigzag foldable structure of the supporting arm, wherein each pair of intersecting bars are pivotally connected through a hinge. In this configuration of the supporting arms, the retractable mechanism may include a drive shaft and a transmission mechanism enabling to rotate the drive shaft, wherein one bar set of each supporting arm movably connects to the drive shaft through a connector in a manner that allows converting the rotational movement of the drive shaft into a lateral movement of each connector, which in turn causes each respective supporting arm to fold and unfold, depending upon rotational direction of the drive shaft. The other bar set of each supporting arm (that does not connect to the connector) pivotally connects to a vertical hinge for allowing rotation thereof upon lateral movement of the connector and the bar set connected thereto for allowing folding and unfolding of each of the supporting arms.

Optionally, at least part of the drive shaft is screw threaded wherein each connector movably connects to the drive shaft via a slidable member, wherein the slidable member comprises an inner threaded opening configured for receiving the threaded part of the drive shaft therein, allowing thereby the rotational movement of the drive shaft to translate into lateral movement of each connector by screwing of the drive shaft through the threaded opening of each slidable member upon rotation of the drive shaft.

Optionally, the transmission mechanism comprises a motor configured for rotating the drive shaft.

Additionally or alternatively, the transmission mechanism comprises a gear set including multiple cogwheels configured for being rotated by the motor and for rotating the drive shaft.

The transmission mechanism may additionally or alternatively include a rotatable handle rotatably connected to the gear set or directly to the drive shaft for allowing manual rotation thereof.

DETAILED DESCRIPTION OF SOME EMBODIMENTS OF THE INVENTION

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

The present invention discloses a sheltering device which can be attached to the top of different types of objects such as buildings, vehicles, airplanes or vessels. The device is designed to provide an extended sheltering beyond the shade of the object. Although some of the embodiments described in this document refer to a design adapted for a vehicle, the device can be designed in different sizes to fit to different type and size of structures. The sheltering device includes a retractable mechanism for folding and unfolding supporting arms that are configured for opening and closing a flexible cover attached thereoto having varying width. The maximum width of the cover at the open position is significantly larger than the width of the sheltering device housing. The sheltering device is supported only at one end by the object, not requiring additional supporting means. Additionally, the supporting arms are unfolded and folded through movement trajectories that are non-parallel to allow the cover of the above-described configuration to stretch in a sideways and forward movement.

According to some embodiments of the present invention, the cover may support a photovoltaic cells system.

The configuration of the sheltering device having supporting arms thereof unfolding through non-parallel trajectories, allows the arms to extend the width of the cover throughout the unfolding process, up until its final position is reached, in which the arms create 2 (or more) stable supporting points suspended in air at the distal edges and/or along the bars, which provide tension to the cover attached in all required direction, thus eliminating the necessity of using a ridged connection between these distal edges. This allows the cover to be held hung over exclusively by the supporting arms.

Figure 13:
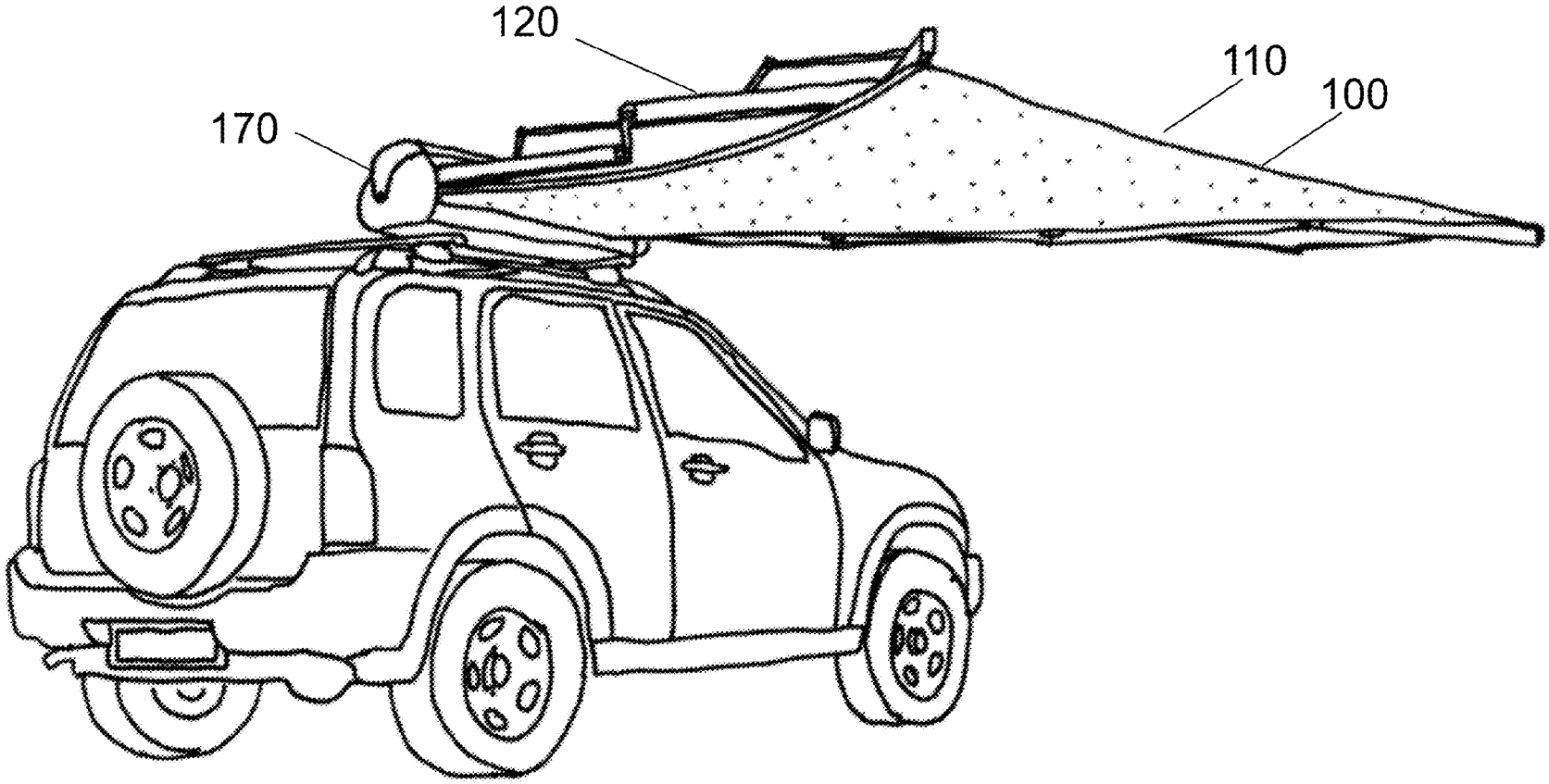
FIG. 13 illustrates a sheltering device installed over the roof a vehicle, according to other embodiments of the present invention.

FIG. 1 illustrates the sheltering device 100 in an open position in accordance with some embodiments of the present invention. The sheltering device 100 includes a flexible cover sheet 110 having a trapezoidal shape. Using a trapezoidal shape is only one possible geometrical shape, any other geometrical shape having a varying width can be used. For example, any portion of a semicircle can be used. The flexible cover 110 is supported by two foldable arms 120, one located beneath the cover and other above the cover. The cover 110 edge is attached to the end of each arm 120, such that when the arms 120 unfold, they stretch the cover 110 to its maximum span, as seen in FIG. 13. Each arm 120 is comprised of two sets of interconnected bars 125, where the two sets are optionally connected by pins (not shown). The bars' sets at the open position have a horizontal zigzag shape intersecting each other, forming a wide support for the cover 110. At least one bar of each set is hollow, encapsulating at least one spring which in its normal position tends to unfold the bars. The arms 120 move in a two dimensional travel courses, simultaneously stretching the cover forward and sideways.

Figure 2:
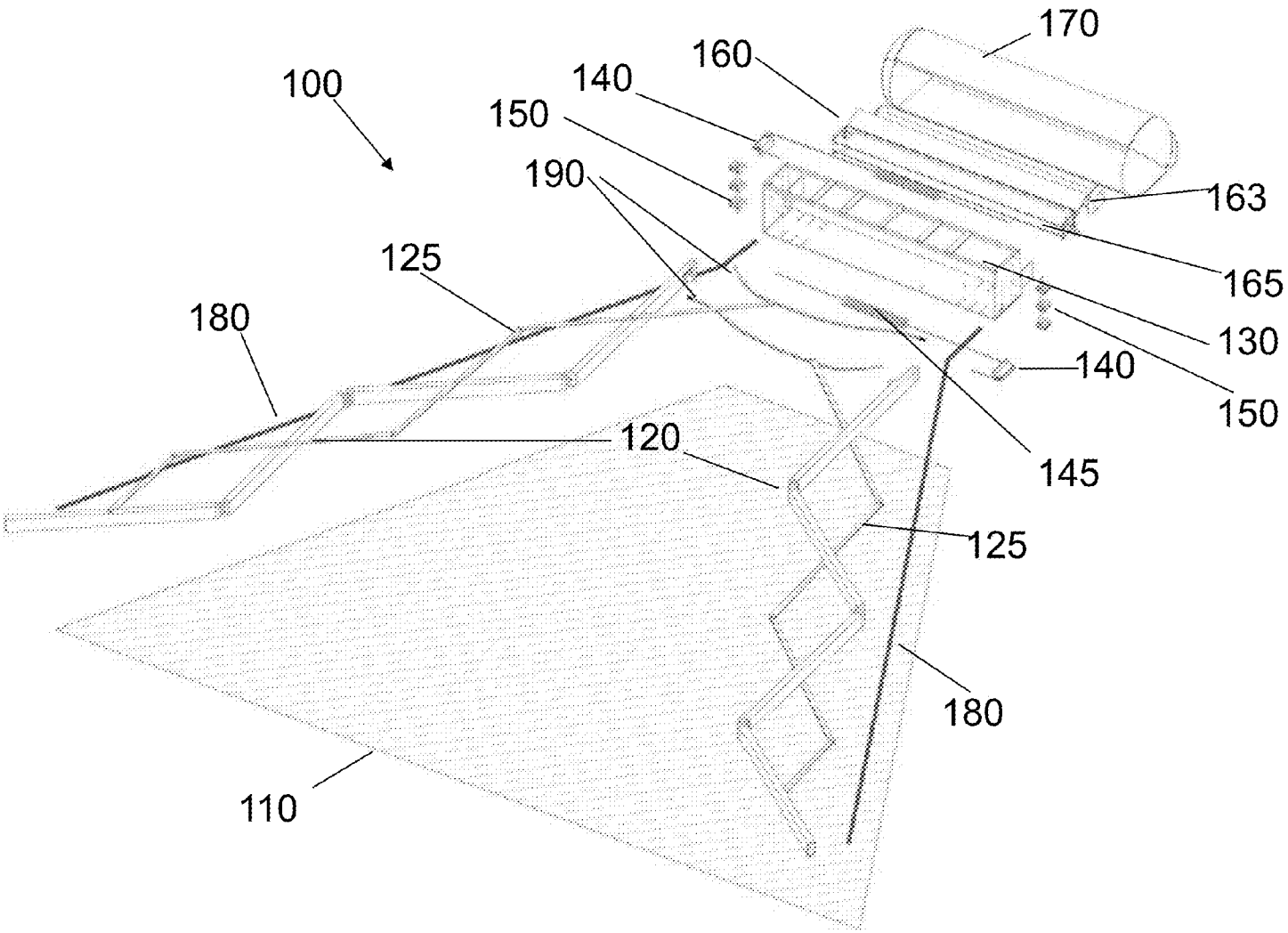
FIG. 2 illustrates an exploded view of the sheltering device components, according to the first embodiment of the present invention.

FIG. 2 illustrates an exploded view of the sheltering device 100 components according to some embodiments of the present invention. The housing 170 of the device 100 encapsulates a roller 163 on which the flexible cover 110 is folded, a structure 160 which integrates plates forming a slot 165 through which the cover 110 is stretched out, cables 140 for folding and unfolding the supporting arms 120, axis pins 150 and two strips 180 attached along the two sides of the cover 110. The strips 180 on the inner end are connected to the roller edges 163 and on the other end are connected to the edges of the arms 120. When operating the sheltering device 100 to stretch the cover, an electronic motor enclosed within the roller (not shown) is turns the roller 163 to unfold the cover 110, decreasing the tension of springs located inside the arm's bars (not shown) and springs 145 associated with the cables 140. The release of the springs causes the arms 120 to open to their full span, as shown in FIG. 1. The supporting arms 120 move in a two dimensional travel course, stretching the cover 110 forward and sideways throughout the opening, by pooling the strips 180 forward and sideways. The strips 180 are attached to the cover 110 using connectors such as Velcro™, magnets or any other fastening mechanism. Through the closing process of the cover 110, the motor turns the roller 163 to fold the cover 110 with the strips 180 back into the roller 163. The cover 110 retracts back into the housing 170, pooling the tips of the supporting arms 120, which cause the arms 120 to unfold back into the housing.

The device 100 may further include curved bars 190 connected to the thinner set of bars 125 of the supporting arms 120 which slide on the curved bars 190, hence the movement of the supporting arms 120 edges is two dimensional and is restricted by the curved bars 190 form.

Figure 3:
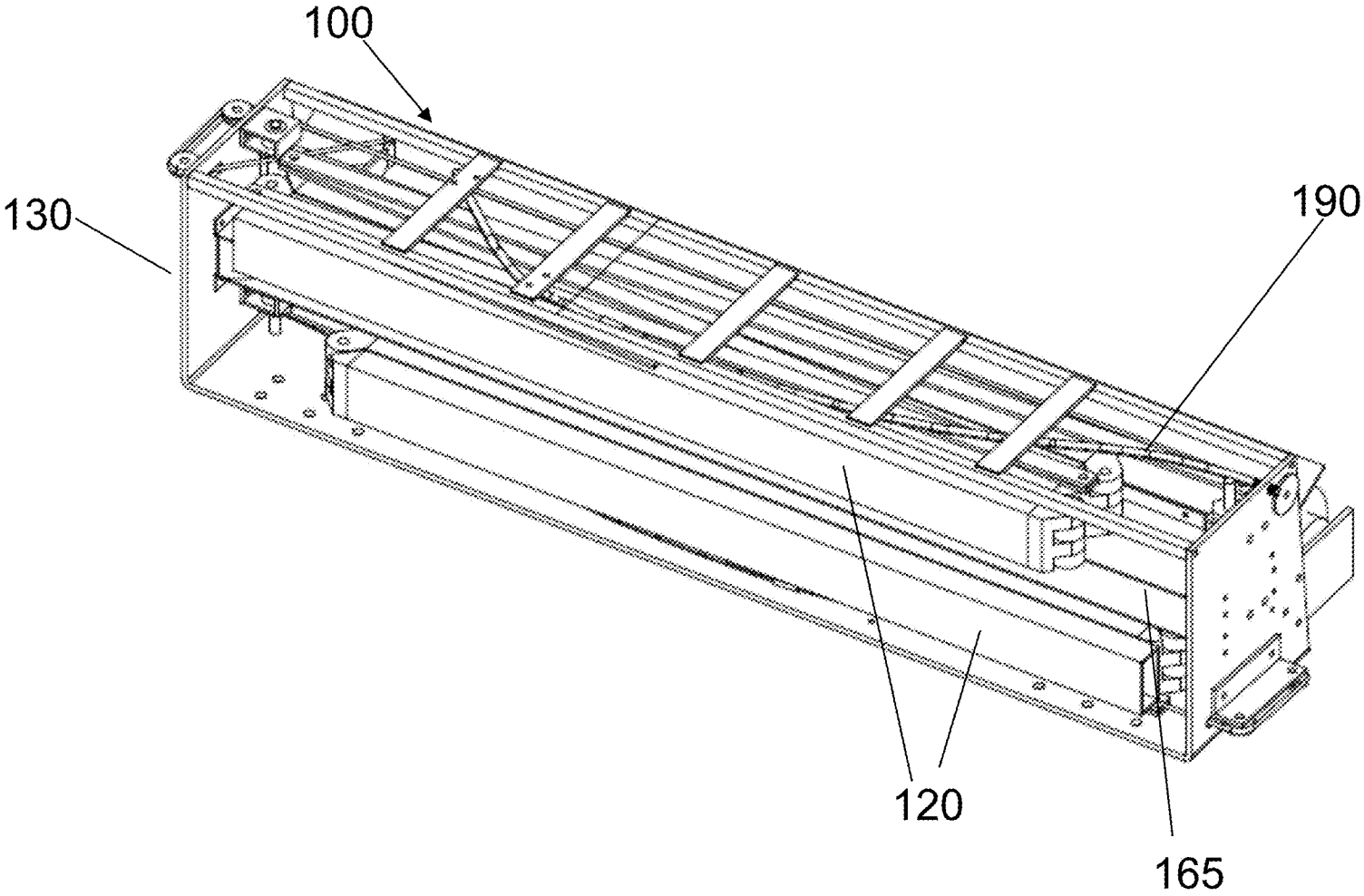
FIG. 3 illustrates the mounting of the sheltering device as described in FIG. 1, in a closed position according to the first embodiment of the present invention.

FIG. 3 illustrates the mounting of the sheltering device 100 according to some embodiments of the present invention. The figure illustrates the supporting arms 120 in their folded position fitting in the mounting structure, located one above the other and the slot 165 which is formed by the plate structure 160 (as shown in FIG. 2), through which the cover stretches out of the mounting. The curved bars 190 are shown at the rear end of the mounting in the folded position of the cover.

Figure 4:
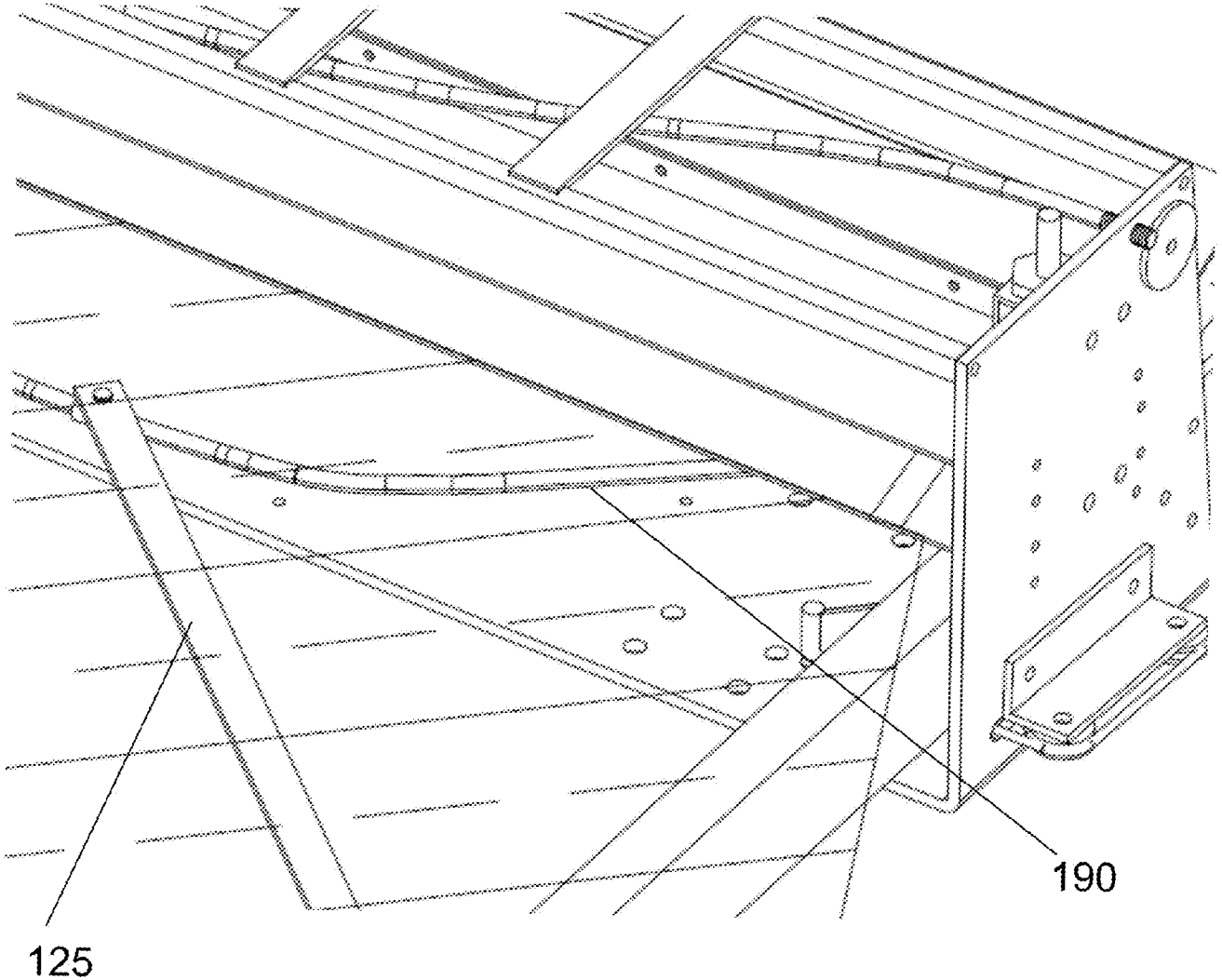
FIG. 4 illustrates a detailed view of the sheltering device described in FIG. 1, according to the first embodiment of the present invention.

FIG. 4 illustrates detailed view of the inner part within the mounting at open position according to some embodiments of the present invention. It can be seen that thinner bars 125 are connected and configured to slide along the curved bar 190, guiding the movement of the supporting arms 120.

Figure 5:
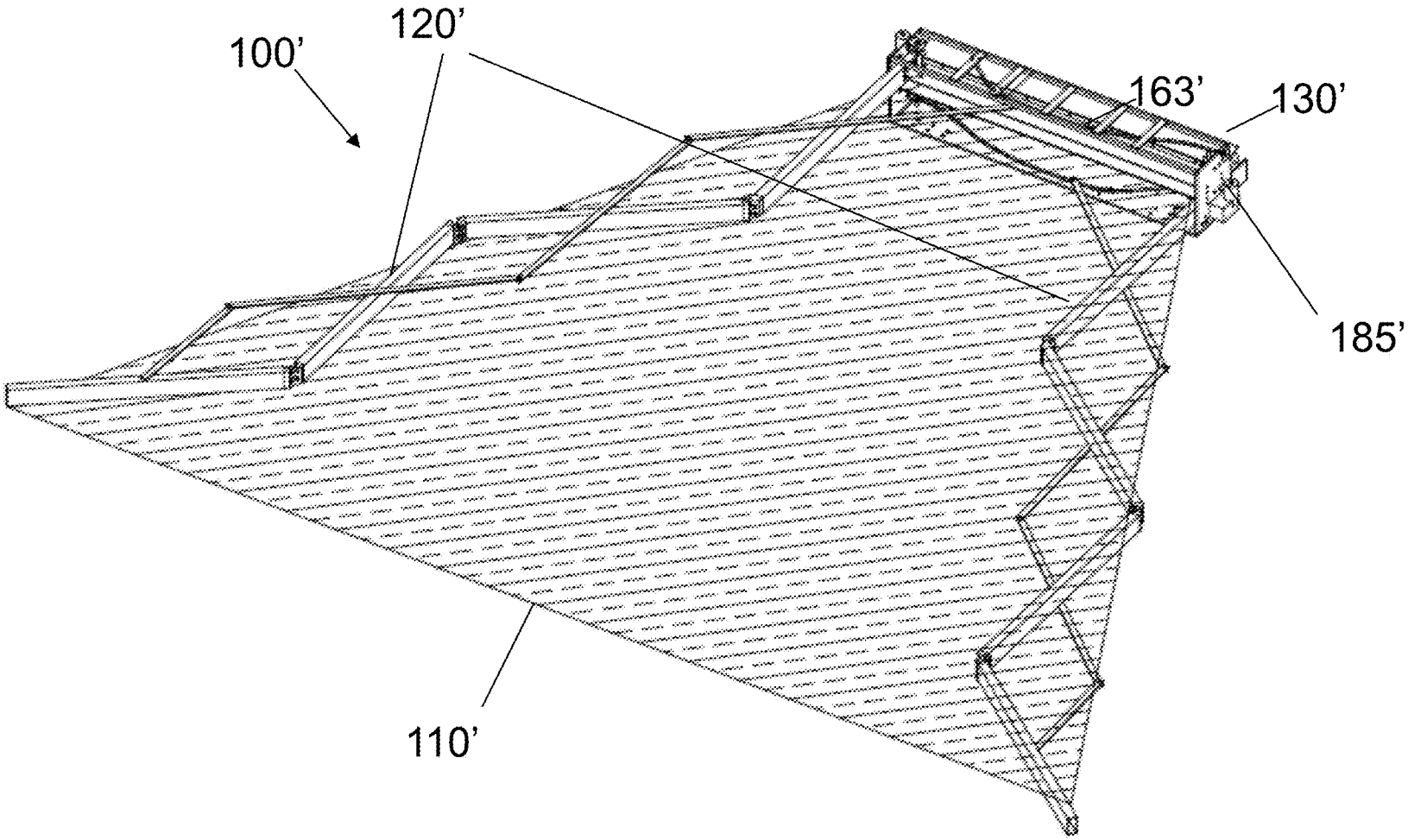
FIG. 5 illustrates the mounting of the sheltering device in an open position according to a second embodiment of the present invention.

FIG. 5 illustrates the sheltering device 100' in an open position in accordance with other embodiments of the present invention. According to this embodiment the supporting arms 120' motion is controlled by at least one electric motor 185 and located next to axis pins 150. Such solution diminishes the use of springs and cables of the supporting arms as were suggested in the embodiment described in FIG. 2. The arms 120' move in a two dimensional travel course, stretching the cover forward and sideways. The same motor may control both the roller 163 and the supporting arms 120'.

Figure 6:
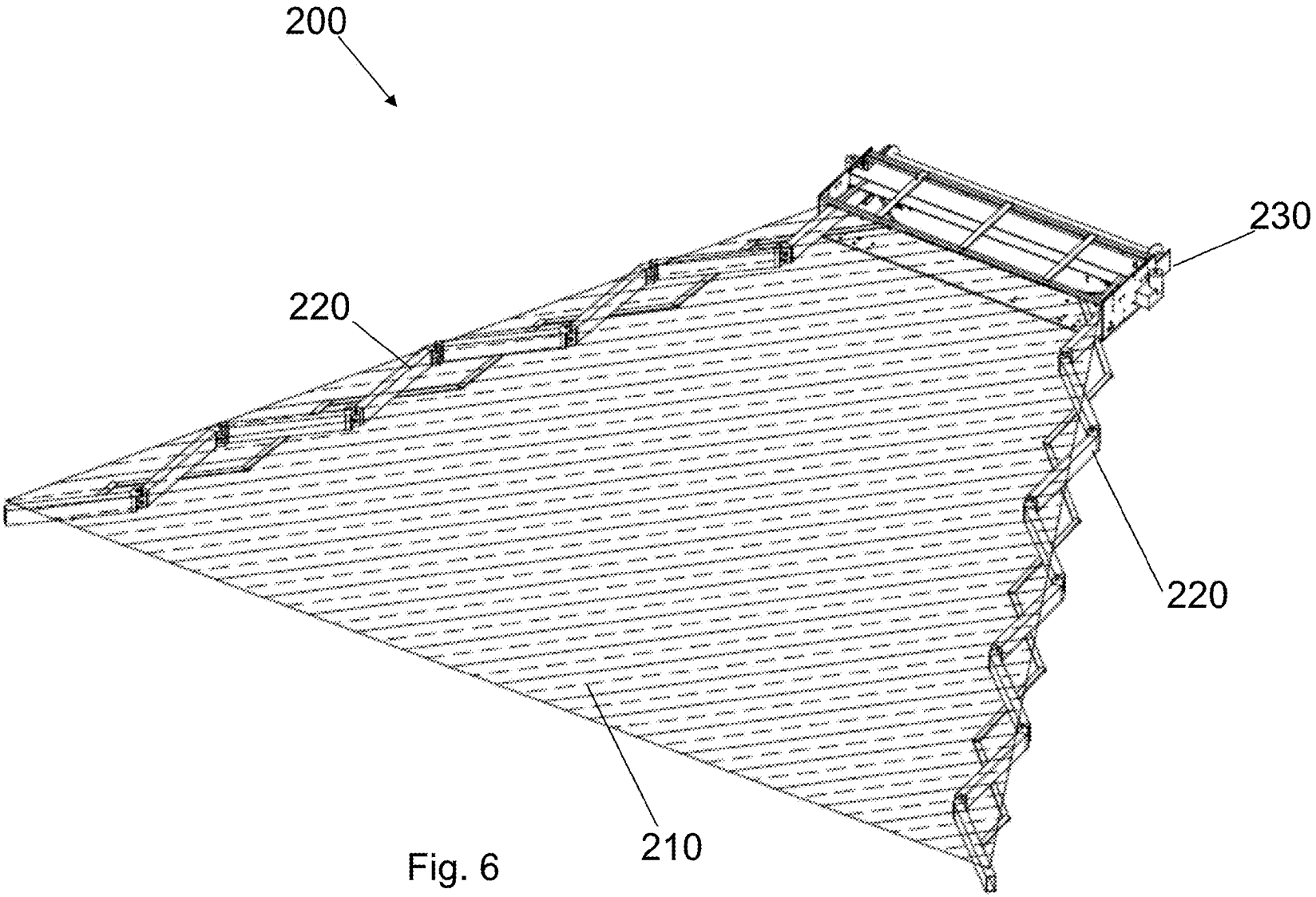
FIG. 6 illustrates the mounting of the sheltering device in an open position according to a third embodiment of the present invention.

FIG. 6 illustrates the sheltering device 200 in an open position in accordance with some embodiments of the present invention. The sheltering device 200 includes zigzag shaped foldable supporting arms 220, a housing 230, a flexible cover 210 and a retraction mechanism for folding and unfolding the supporting arms 230 and cover 210 attached thereto. In accordance with these embodiments the supporting arms 220 are located on the same level. The opening process of the supporting arms 220 is equivalent to the description of in FIG. 5. The arms 220 move in a two dimensional travel course, stretching the cover forward and sideways. This embodiment may include motors as described in FIG. 5 or springs as described in FIG. 2.

Figure 7:
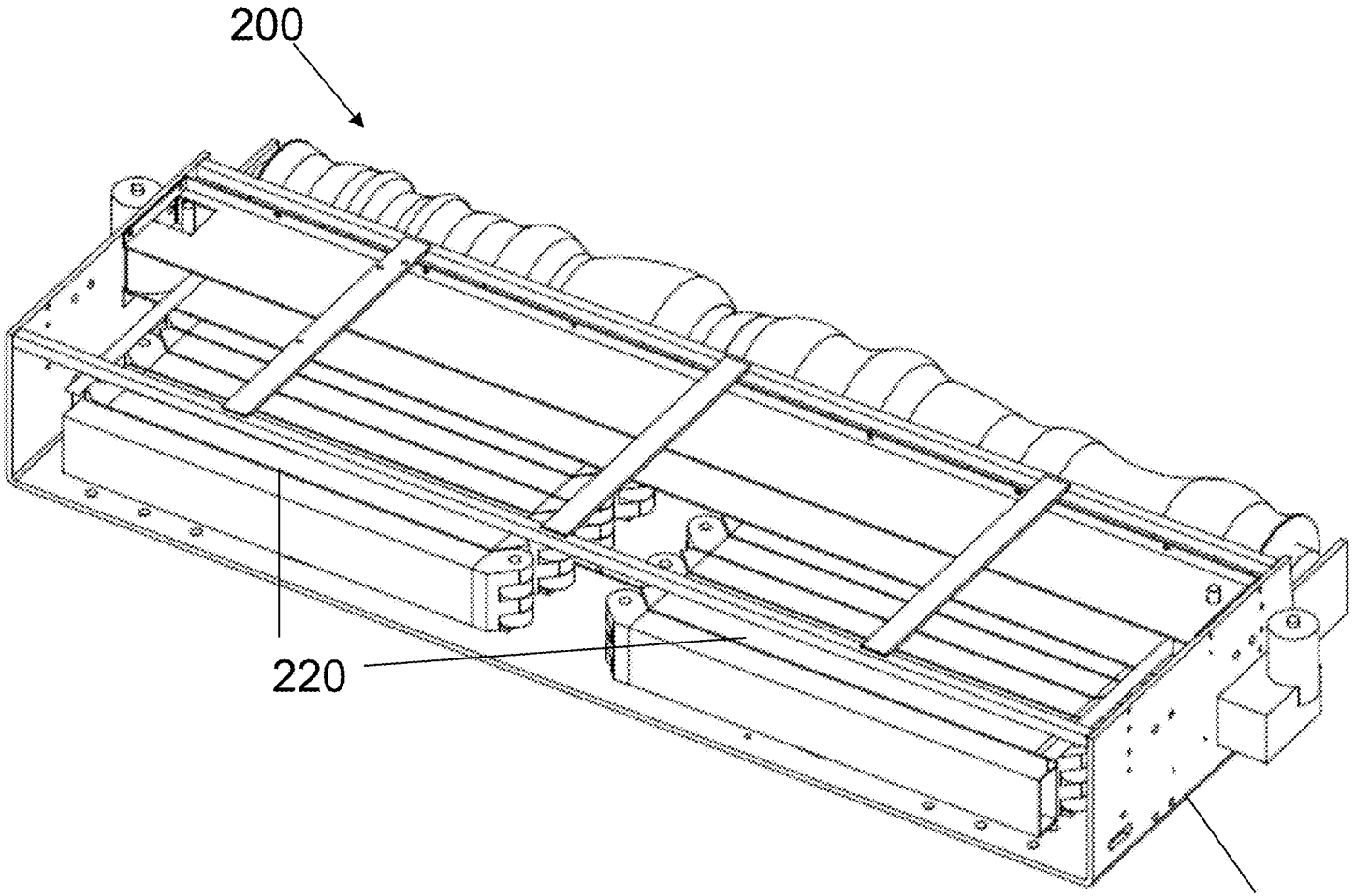
FIG. 7 illustrates the mounting of the sheltering device as described in FIG. 6, in a closed position, according to the third embodiment of the present invention.

FIG. 7 illustrates the mounting of the sheltering device 200 in a folded (closed) position according to some embodiments of the present invention. In accordance with this embodiment the supporting arms 120 are located on the same level, situated side by side within the mounting, in their folded position.

Figure 8:
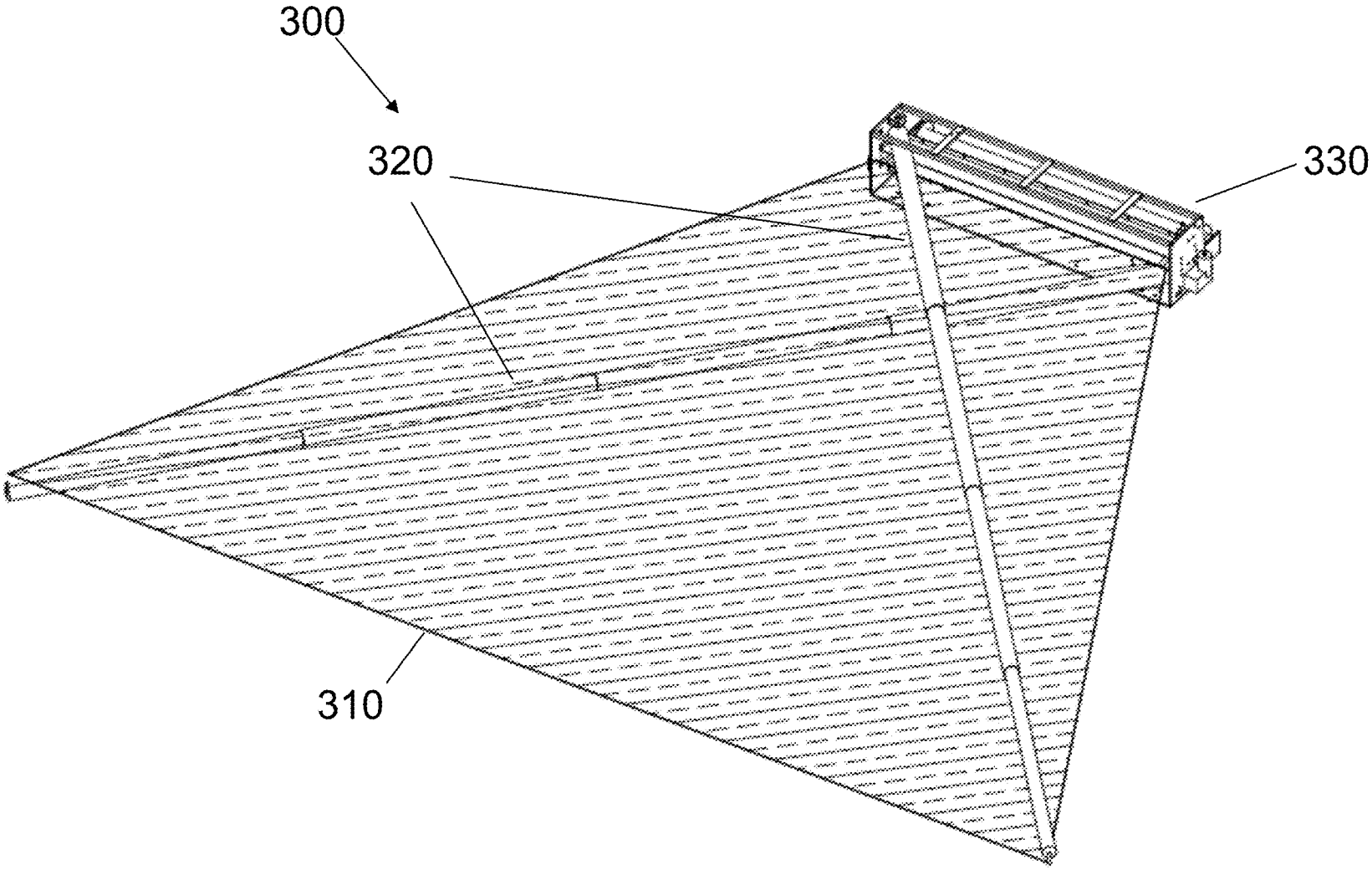
FIG. 8 illustrates a sheltering device having telescopic arms in an open position according to a fourth embodiment of the present invention, wherein the telescopic supporting arms cross-pass one another.

FIG. 8 illustrates a sheltering device 300 in an open position in accordance with another embodiment of the present invention. This sheltering device 300 includes telescopic foldable supporting arms 320, a housing 330, a flexible cover 310 and a retraction mechanism for folding and unfolding the supporting arms 330 and cover 310 attached thereto. In accordance with this embodiment the supporting arms are telescopic. Each arm 320 is comprised of plural hollow pipes elements, collapsing into a single pipe element at the folded position. The telescopic arms 320 move in a two dimensional travel course, stretching the cover 310 forward and sideways. The travel course might be curved or diagonal. The telescopic arms 320 may include springs or pneumatic mechanism encapsulated within the pipe elements.

Optionally the telescopic arms 320 are designed to be opened or closed using pneumatic/hydraulic mechanism. The pipe elements are being extracted or retracted using electric motors and/or pumps, synchronized with the cover roller movement (163 see FIG. 2). According to this embodiment, the telescopic supporting arms 320 cross each other at different levels, pulling out the stripes (180 FIG. 2) as well as the cover 310 attached thereto.

Figure 9:
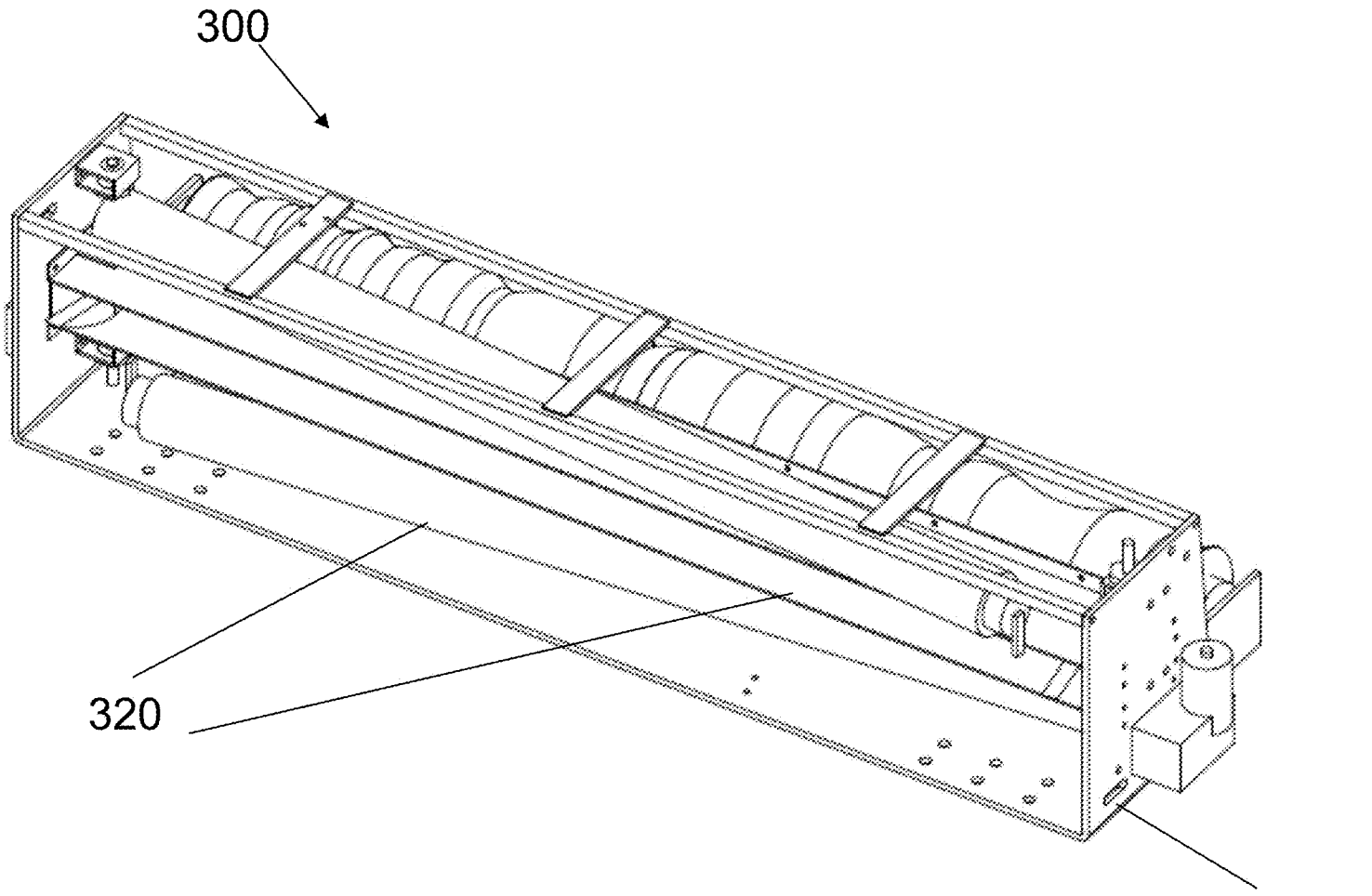
FIG. 9 illustrates the sheltering device as described in FIG. 8, in the closed position, according to the second embodiment of the present invention.

FIG. 9 illustrates the sheltering device having telescopic arms 320 in the closed position in accordance with some embodiments of the present invention. In accordance with this embodiment supporting telescopic arms 320 are located one above the other.

Figure 10:
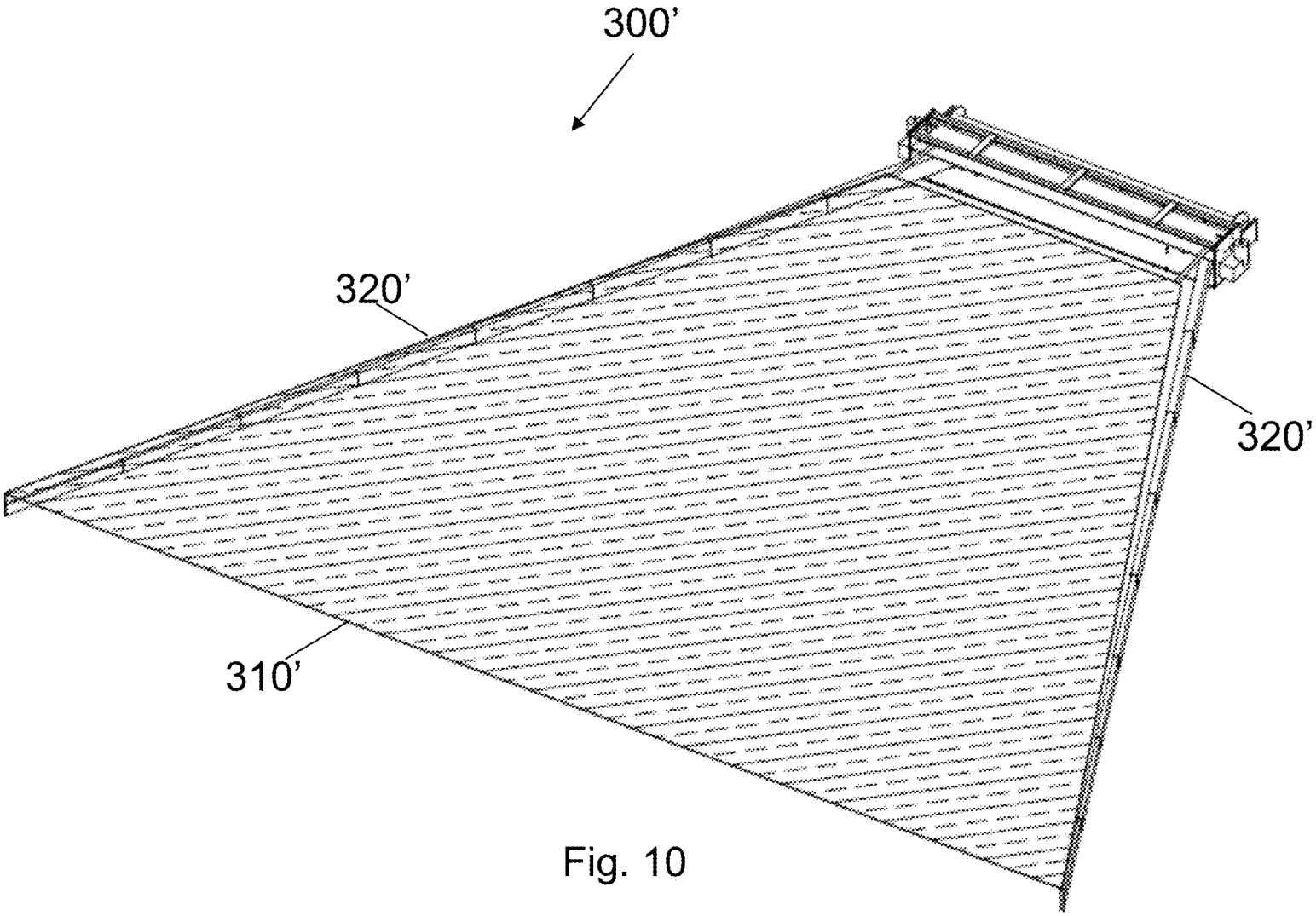
FIG. 10 illustrates a sheltering device having telescopic arms in an open position, according to a fifth embodiment of the present invention.

FIG. 10 illustrates a sheltering device 300' in an open position in accordance with another embodiment of the present invention. In accordance with this embodiment the supporting arms 320' are telescopic and do not cross each other when unfolded into the open position. Each arm 320' is comprised of plural hollow pipe elements, collapsing into a single pipe element at the closed position both at the same level. The retraction mechanisms works at the same techniques described in FIG. 8. When spreading the cover, each arm 320' is rotated in an opposite direction, where at the fully open position the two arms form a trapezoid shape together with the cover. The telescopic arms move in a two dimensional travel course, stretching the cover forward and sideways.

Figure 11:
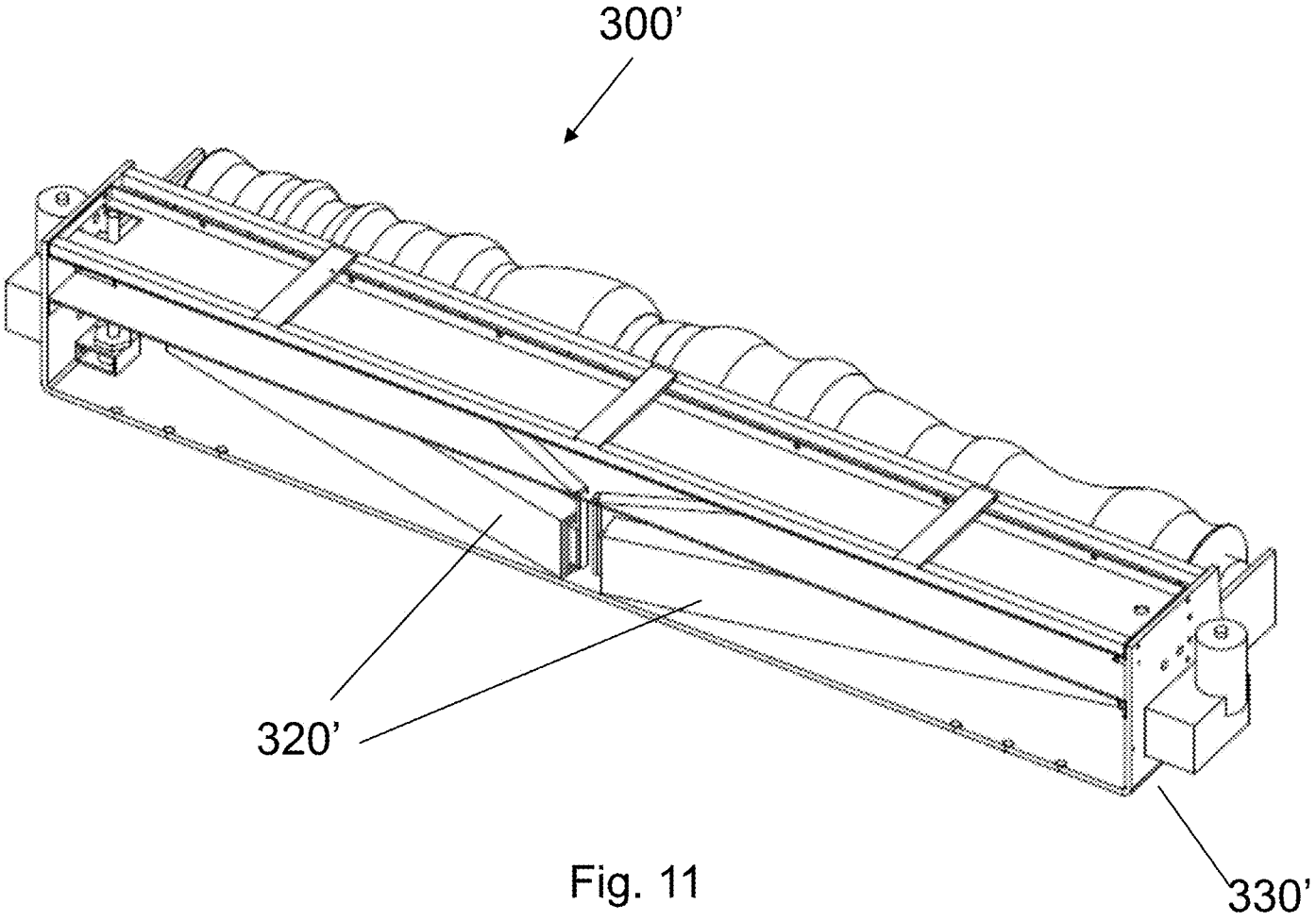
FIG. 11 illustrates the sheltering device as described in FIG. 10, in the closed position, according to the fifth embodiment of the present invention.

FIG. 11 illustrates the sheltering device 300' having telescopic arms 320' in the closed position in accordance with some embodiments of the present invention. In accordance with this embodiment supporting telescopic arms 320' in their folded position are at the same level, one beside the other.

Figure 12:
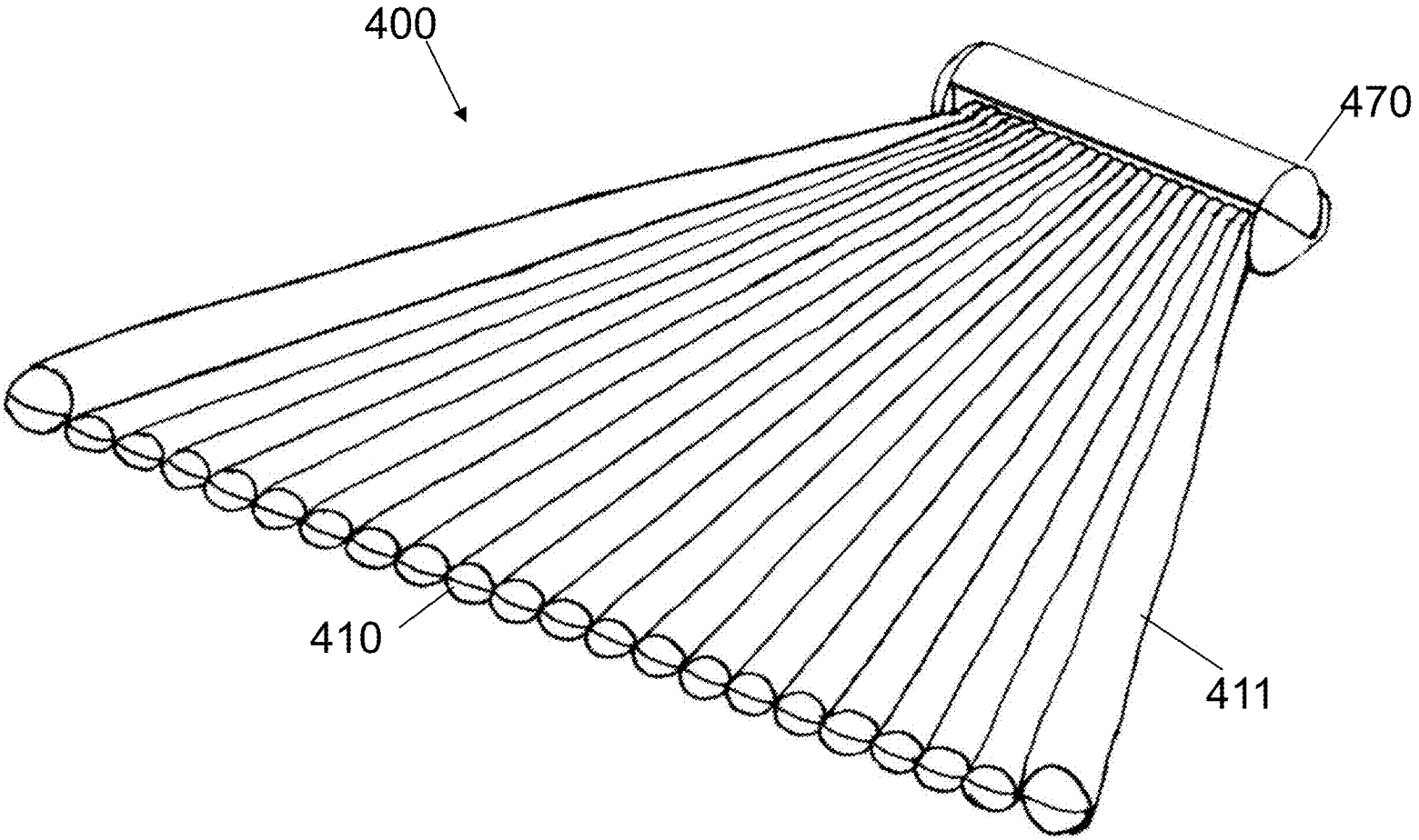
FIG. 12 illustrates a sheltering device in an open position, according to a sixth embodiment of the present invention.

FIG. 12 illustrates a sheltering device 400 in an open position in accordance with other embodiments of the present invention having a cover 410 and a retractable mechanism that is housed by a housing 470. In accordance with these embodiments, the cover 410 is an integration of inflatable elements 411, such that in closed position, the inflatable surface is deflated in compact form fitting into the housing and in the open position is filled with air expanding to a fully expended shape, which is wider than the housing. The inflated shape of the cover may have different shapes such as trapezoid, a fan design or another shape having wider edge at far end of the cover. For this implementation the housing includes a compressor for inflating the cover. Such implementation may include supporting cables or stripe. In accordance with some embodiment, only part of the elements may be inflated, for example: only along the perimeter of the cover, or only at the two opposite diagonal sides, having a flat sheet cover in-between the inflated elements.

FIG. 13 illustrates the sheltered device 100 as described in respect to FIG. 1, installed over the roof of a vehicle according to some embodiments of the present invention. It can be seen, that at the open position the cover 110 provides shade in area besides the vehicle having trapezoid shape, the lager base of the trapezoid cover 110 is wider than the length of the vehicle's roof. It can also be seen that the supporting arms stretch the cover forwards and sideways According to some embodiment of the present invention, the power source operating the motor can use chargeable batteries, solar energy, wind energy etc.

According to other embodiments of the invention the roller may be operated manually by the user, not using electric power.

According to some embodiments of the present invention the device may further comprise side sheets which can be attached to the sides of the cover, creating walls for providing a shelter tent like structure.

According to further embodiment of the present invention the device may be used as sail for generating thrust in reaction to wind power.

According to further embodiment of the present invention the cover may integrate an antennas structure, stretched between the supporting arms.

According to further embodiment of the present invention the device may be used for fishing by replacing the cover with flexible net structure.

According to further embodiment of the present invention the cover may include photo voltaic cells for serving as solar energy collector.

FIGS. 14-20 illustrates a sheltering device 500 or parts thereof, according to other embodiments of the present invention. This sheltering device 500 includes a flexible cover 510 such as a flexible sheet, two sets of foldable supporting arms 520, a retractable mechanism 540 and a casing 570 for housing the retraction mechanism 540 as well as the foldable supporting arms 520*a* and 520*b*, when in a folded (closed) position. The sheltering device 500 attaches to the object such as to a vehicle's roof via any kind of attachment(s) such as through fasteners screwed through the vehicle.

Figure 14:
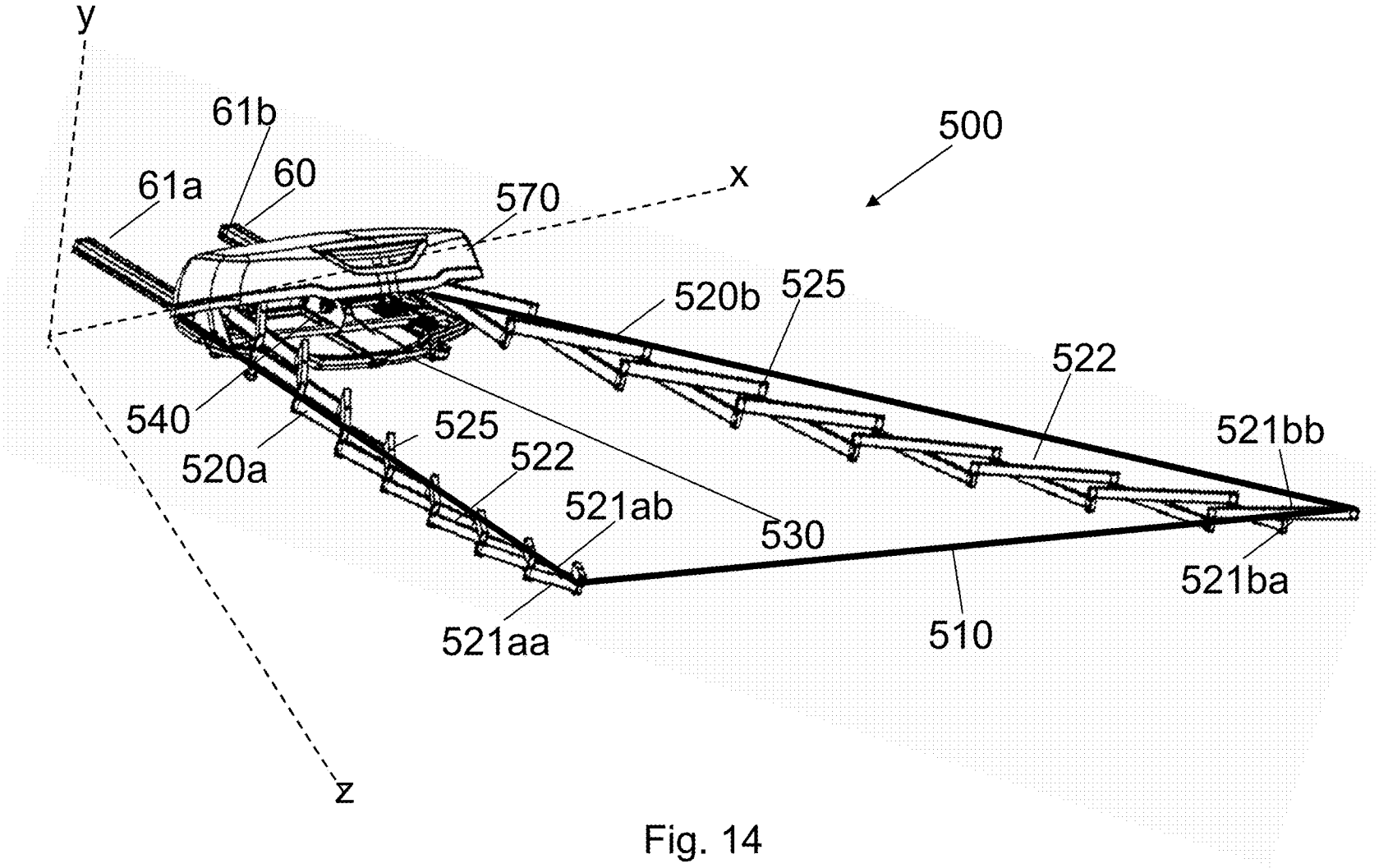
FIG. 14 is an isometric view of a sheltering device according to yet other embodiments of the invention, where the sheltering device is in an open position.
Figure 15:
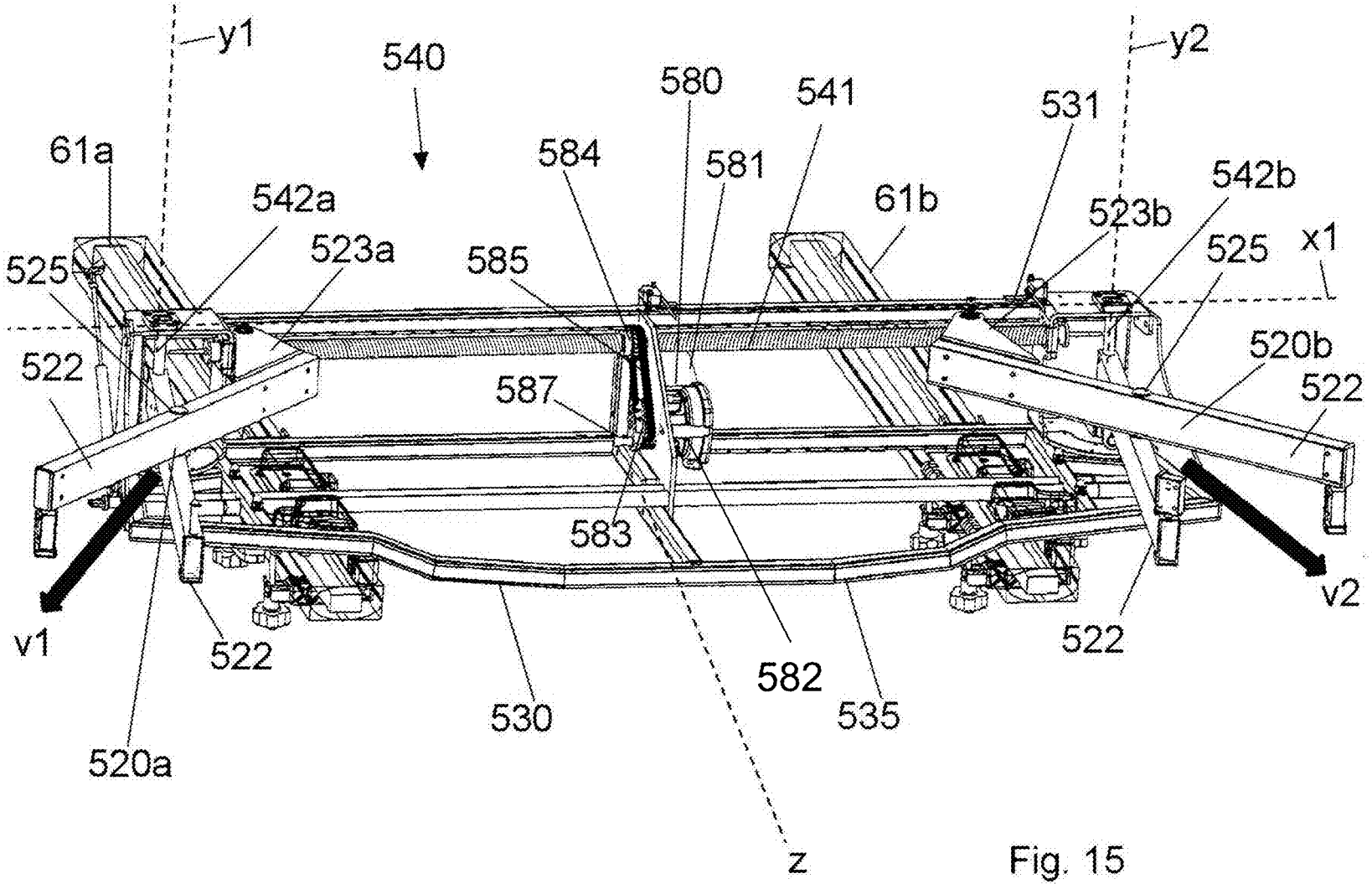
FIG. 15 illustrates a retractable mechanism for unfolding and folding foldable supporting arms of the sheltering device, according to some embodiments of the invention.
Figure 18:
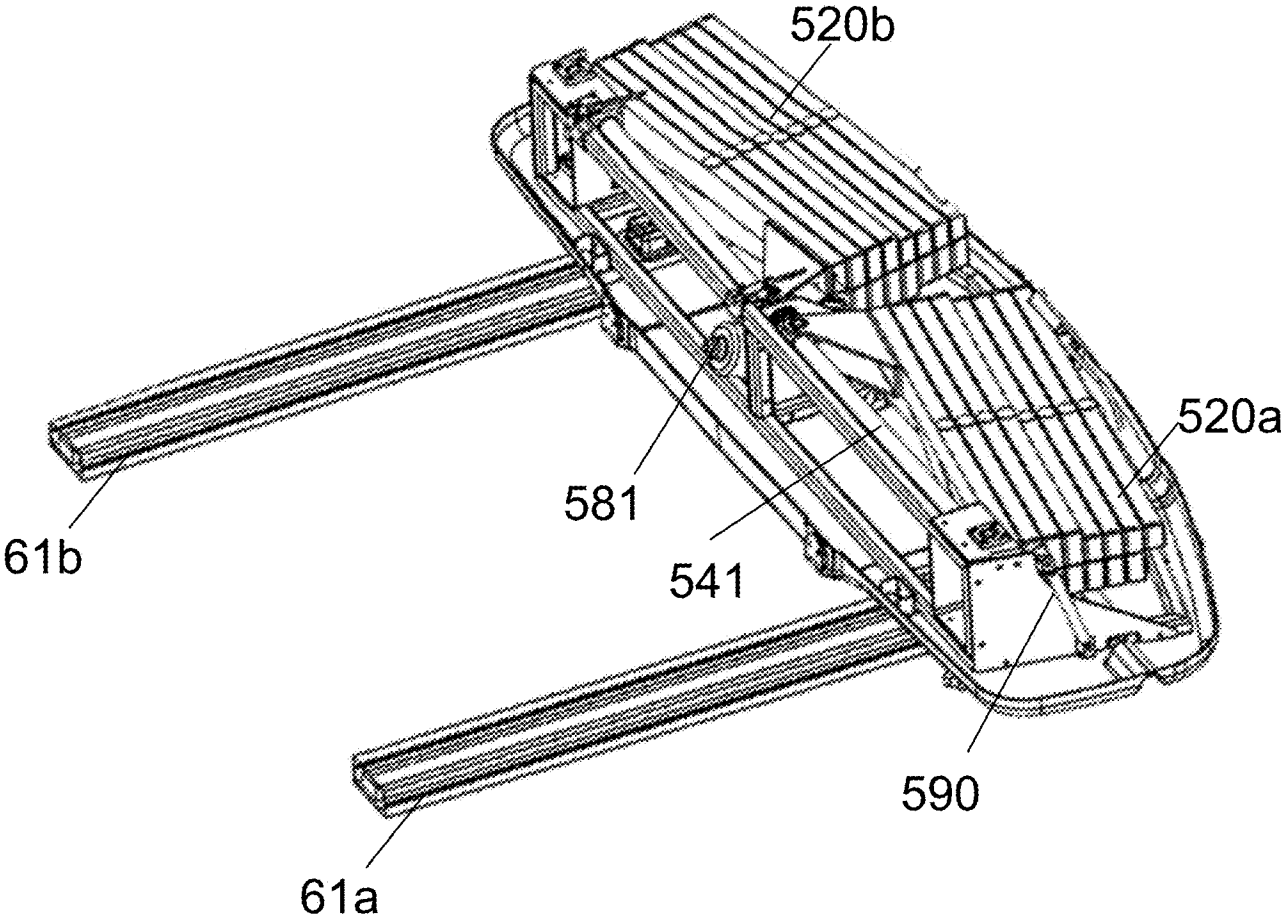
FIG. 18 shows a rear isometric view of the sheltering device without a casing thereof in a folded closed position, according to some embodiments of the invention.

Each of the foldable supporting arms 520*a* and 520*b* includes two sets of interconnected bars 522 intercrossing one another, where each pair of intercrossing bars 522 pivotally connect to one another through a hinge 525 to form a foldable zigzag (scissor-like) structure such that each foldable supporting arm 520*a*/520*b* can fold and unfold by rotation of its intercrossing bars 522. As illustrated in FIGS. 14-15 and 18, the foldable supporting arms 520*a* and 520*b* are configured to simultaneously move along predefined non-parallel trajectories "$v_1$" and "$v_2$" when folding and unfolding, to allow the flexible cover 510, attached thereto, to unfold in a forward/backward and sideways movement throughout the unfolding/folding thereof, respectively. This means that the cover 510 is opened and closed (unfolded and folded) over a two dimensional plane XZ, which is perpendicular to a vertical axis "y" (where "y" is parallel to the rotational pivot of hinges 542*a* and 542*b*, used for folding and unfolding the arms 520*a* and 520*b*, respectively). Each supporting arm 520*a* and 520*b* is therefore constructed by two zigzagging sets of bars: the first supporting arm 520*a* is constructed by bar-sets 521*aa* and 521 ab and the second supporting arm 520*b* is constructed of bar sets 521*ba* and 521*bb*, as illustrated in FIG. 14.

Each of the trajectories $V_1$ and $V_2$ of each respective supporting arm 520*a* and 520*b* forms an angle with a Z axis (see FIG. 15) that is substantially higher than 90° to allow unfolding a cover 510 that is trapezoid or a sector of a circle or any other shape that has a base that is significantly shorter than the length of its opposite side, to allow maximal sheltering coverage.

According to some embodiments, as illustrated in FIG. 15, the retractable mechanism 540 is configured for folding and unfolding the cover 510 by folding and unfolding of the supporting arms 520*a* and 520*b* connected thereto. To do so, the retractable mechanism 540 optionally includes a drive shaft 541 that is rotatable by a transmission mechanism 580, configured for actuating the drive shaft 541. The transmission mechanism 580 includes a gear set having multiple cogwheels 582-584 rotatable by a main motor 581, where the cogwheels rotate one another optionally through one or more transmission strips such as strip 585. One of the cogwheels 584 connects to and rotates the drive shaft 541, which in turn transforms the rotational movement thereof into a lateral movement of connectors 523*a* and 523*b*. Each such connector 523*a* and 523*b* connects to an end of one bar-set 521*aa* and 521*ba* respectively where the end of the other bar-set 521*ab* and 521*bb*, respectively, pivotally connects to a vertical hinge 542*a* and 542*b* defining rotation axes $y_1$ and $y_2$ respectively. In this configuration, the lateral movement of a respective connector 523*a* and 523*b* causes the opposite bar-set thereof 521*ab* and 521*bb* to rotate around its respective hinge 542*a* and 542*b* for folding or unfolding of the supporting arms 520*a* and 520*b* simultaneously since both connectors 523*a* and 523*b* connect to the same drive shaft 541. In this configuration, the lateral movement of the connectors 523*a* and 523*b* towards one another will cause the supporting arms 520*a* and 520*b* to fold into the closed position (see FIG. 18) and the lateral movement of the connectors 523*a* and 523*b* away from one another will cause the supporting arms 520*a* and 520*b* to unfold to the open position (see FIGS. 14-15).

Optionally, as illustrated in FIG. 14, the supporting arms 520*a* and 520*b* are curved upwards at the open position of the sheltering device 500, such that when unfolded and/or fully opened their upward bending contrasts the wind and gravitational force pulling the arms 520*a* and 520*b* and cover 510 downwards.

Figure 19:
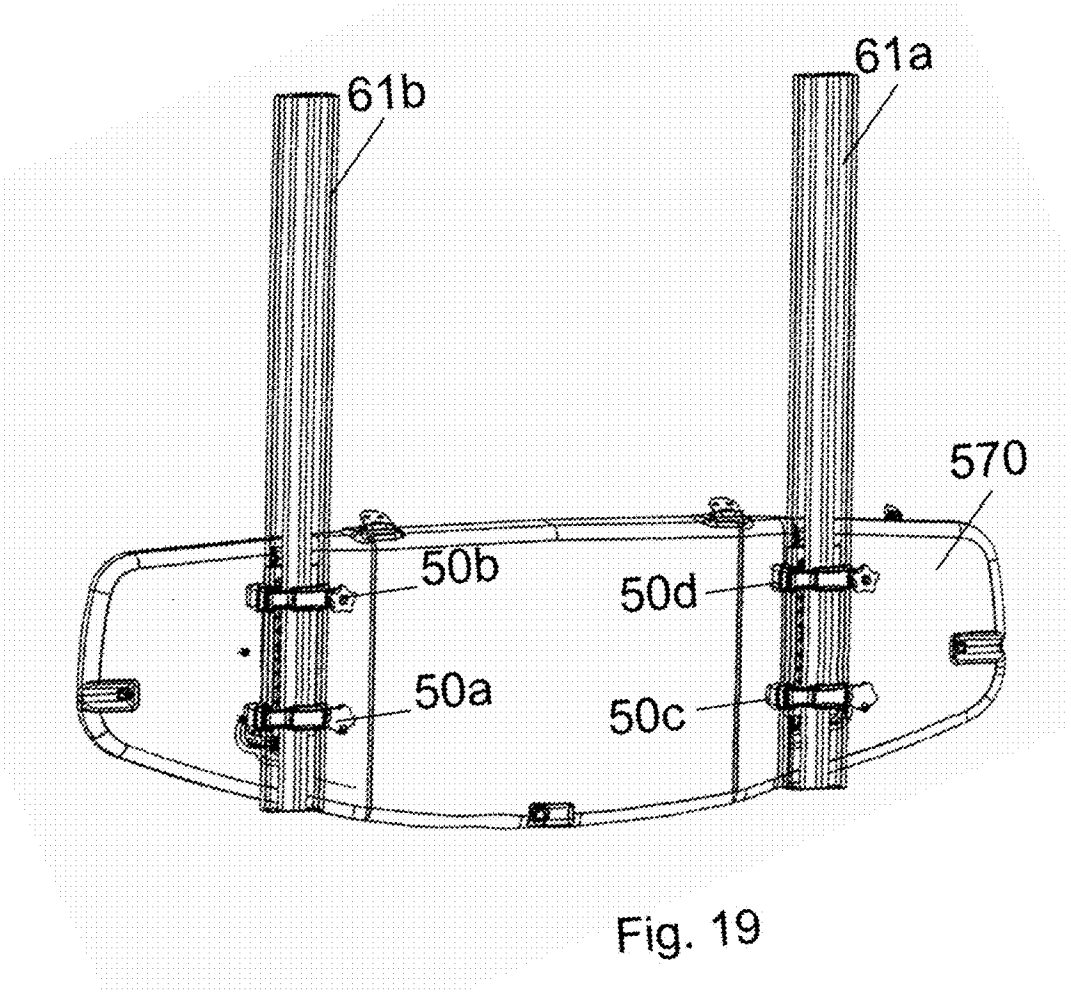
FIG. 19 shows a bottom view of the sheltering device in a folded closed position, according to some embodiments of the invention.
Figure 20:
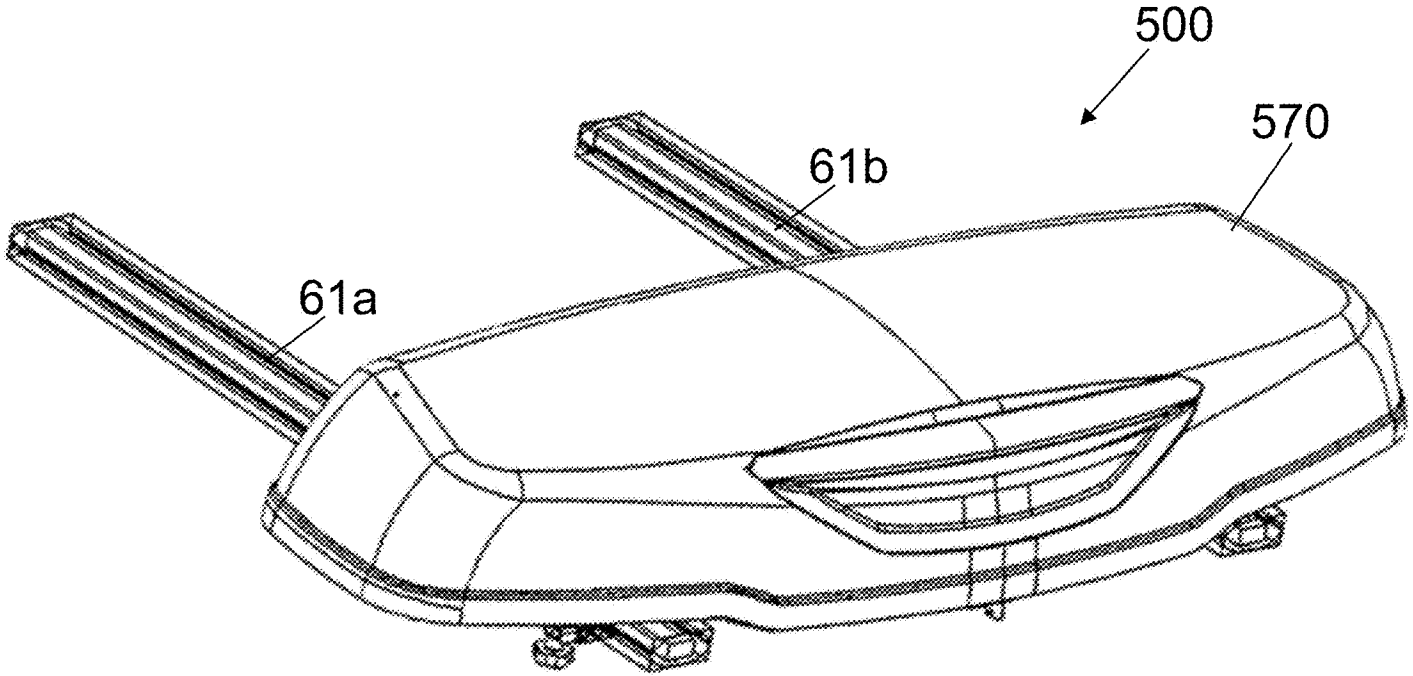
FIG. 20 shows is an isometric view of the sheltering device in a closed position having the casing thereof also closed, according to some embodiments of the invention.

According to some embodiments, as illustrated in FIGS. 14-15 and 19, the sheltering device 500 can be attached to a cargo carrier structure mounted on the vehicle's roof where the carrier includes multiple support rails such as support rails 61*a* and 61*b*. The lower part of the casing 570 connected to the base 535 of the chassis 530 connects to the support rails 61*a* and 61*b* through fasteners 50*a*-50*d* allowing adjusting the location of the casing 570 and therefore the entire sheltering device 500 in respect to the object at the installation stage of the device 500, by determining where along the support rails 61*a* and 61*b* the fasteners should be placed.

Additionally or alternatively, the casing 570 is openable via an opening and closing mechanism such as through a piston based lever 590 configured for automatically opening and closing of the casing 570 cover upon unfolding and folding of the supporting arms 520*a* and 520*b* and cover 510. The piston may be spring-based and/or pneumatic. According to some embodiments, the mechanical opening of the casing 570 switches on the motor 581.

Optionally, the motor 581 can be connected to the car's electric system for receiving power from the vehicle's battery. In other embodiments a separate power source (battery) is used or both options are available for enabling both connecting to the car battery power and/or use a separate power (such as by using solar panel connected thereto and installed over the vehicle's roof or over the device's 500 casing 570). Having a separate independent power source may also allow installing the device 500 over other object than vehicles such as side wall of a house, natural objects such as over trees and the like.

Figure 17:
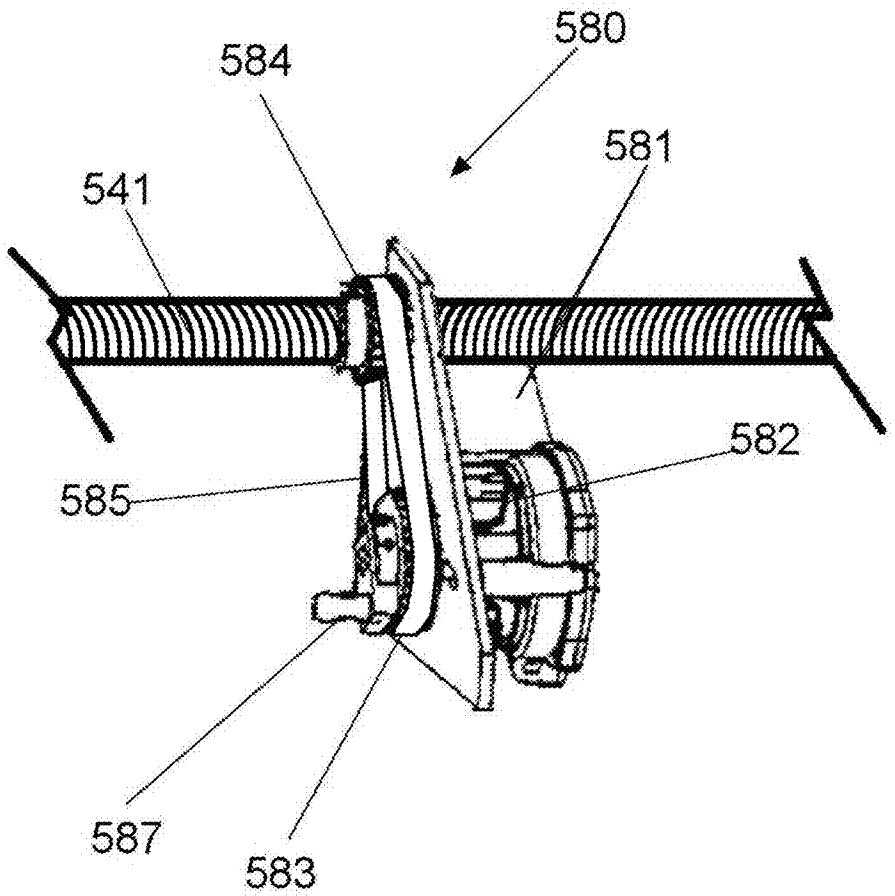
FIG. 17 shows a transmission mechanism configured for electronic and manual operation of the retractable mechanism.

Optionally, as illustrated in FIGS. 15 and 17, the transmission mechanism 580 also includes a handle 587 operatively connected to the gear set through the first cogwheel 583 for rotating the drive shaft 541 for manually folding and unfolding of the cover 510. This handle 587 may serve as a replacement or backup manual actuation of the sheltering device 500 for cases in which no electric energy is available (e.g. non-motorized objects).

As illustrated in FIG. 15 the drive shaft 541 has an external (male) screw threading where one side thereof has screw threading grooves oriented at one direction and the other part thereof has screw threading grooves oriented to an opposite direction to allow the connectors 523*a* and 523*b* to be laterally moved to opposite directions by and along the drive shaft 541 when the drive shaft 541 is rotated.

Figure 16B:
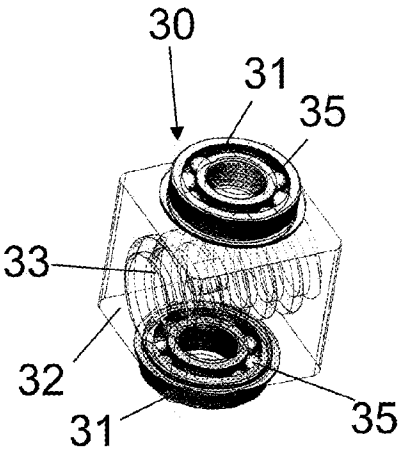
FIG. 16B shows a slidable member that is configured to move along the drive shaft for folding and unfolding of the foldable supporting arms of the sheltering device, according to some embodiments of the invention.
Figure 16A:
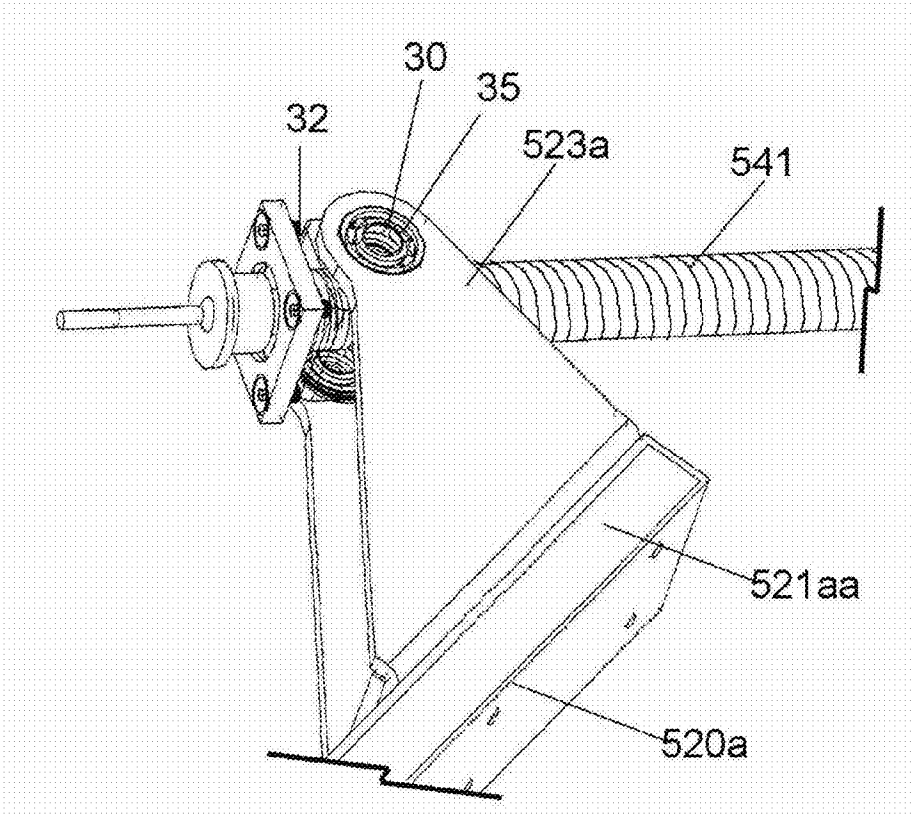
FIG. 16A shows a connector, movably connected to a drive shaft of the retractable mechanism, according to some embodiments of the invention.

Reference is now made to FIGS. 16A and 16B, schematically showing how the supporting arm 520*a* movably connects to the drive shaft 541 via the connector 523*a*. The rotational movement of the drive shaft 541 is translated into a lateral movement of the connector 523*a* by using a slidable member 30 having an opening with an internal screw threading 33 perforated therethrough. When the drive shaft 541 is rotated it is screwed into or out from the opening's thread 33 of the slidable member 30 (depending on rotational direction) causing thereby the slidable member 30 to laterally slide along the drive shaft 541. The same principle and components are used on the other side to translate the rotation of the drive shaft 541 into the lateral movement of the second connector 523*b* for unfolding and folding of the supporting arm 520*b* connected thereto where the screw threading grooves of the shaft 541 side that is threaded through the sliding member 30 of the second connector 523*b* are to an opposite direction to the part of the drive shaft 541 that is threaded through the sliding member 30 of the first connector 523*a*.

According to some embodiments, illustrated in FIGS. 16A and 16B, the connector 523*a* connects to the sliding member 30 through an adaptor 31 having bearings 35 placed in a designated groove thereof for smoothing the interface between the connector 523*a* and the sliding member 30.

Optionally, as illustrated in FIG. 16A, the connector 523*a* fixedly connects to the edge bar 522 of its respective first bar set 521 aa. In a similar manner, the other connector 523*b* fixedly connects to the edge bar 522 of its respective first bar set 521*ba*.

According to some embodiments, as illustrated in FIGS. 15-16A, the connector 523*a*/523*b* is triangular having one of its vertex connected to the sliding member 30 and an opposite side of that vertex connecting to the edge bar 522 of one of the bar sets 521*aa*/521*ba* of each arm 520*a*/520*b*. This configuration allows extending the length of the edge bar 522 connected to the connector 523*a*/523*b* for allowing it to extend along the drive shaft 541 when folding the supporting arms 520*a* and 520*b* for folding of the flexible cover 510.

According to other embodiments of the invention, the sheltering device 500 does not include the connectors 523*a* and 523*b* but instead one edge bar 522 of a the first bar set 521*aa*/521*ba* is slightly longer than the crossing bar of the second bar set 521*ab*/521*bb* to allow the longer bar 521*aa*/521*ba* to connect directly to the sliding member 30, while the shorter bar of each second bar set 521*ab*/521*bb* pivotally connects to the vertical hinges 542*a* and 542*b*.

According to some embodiments, the sheltering device 500 includes a retraction support mechanism for improving refraction of the supporting arms 520*a* and 520*b* when folded back to a closed/folded position.

Figure 21:
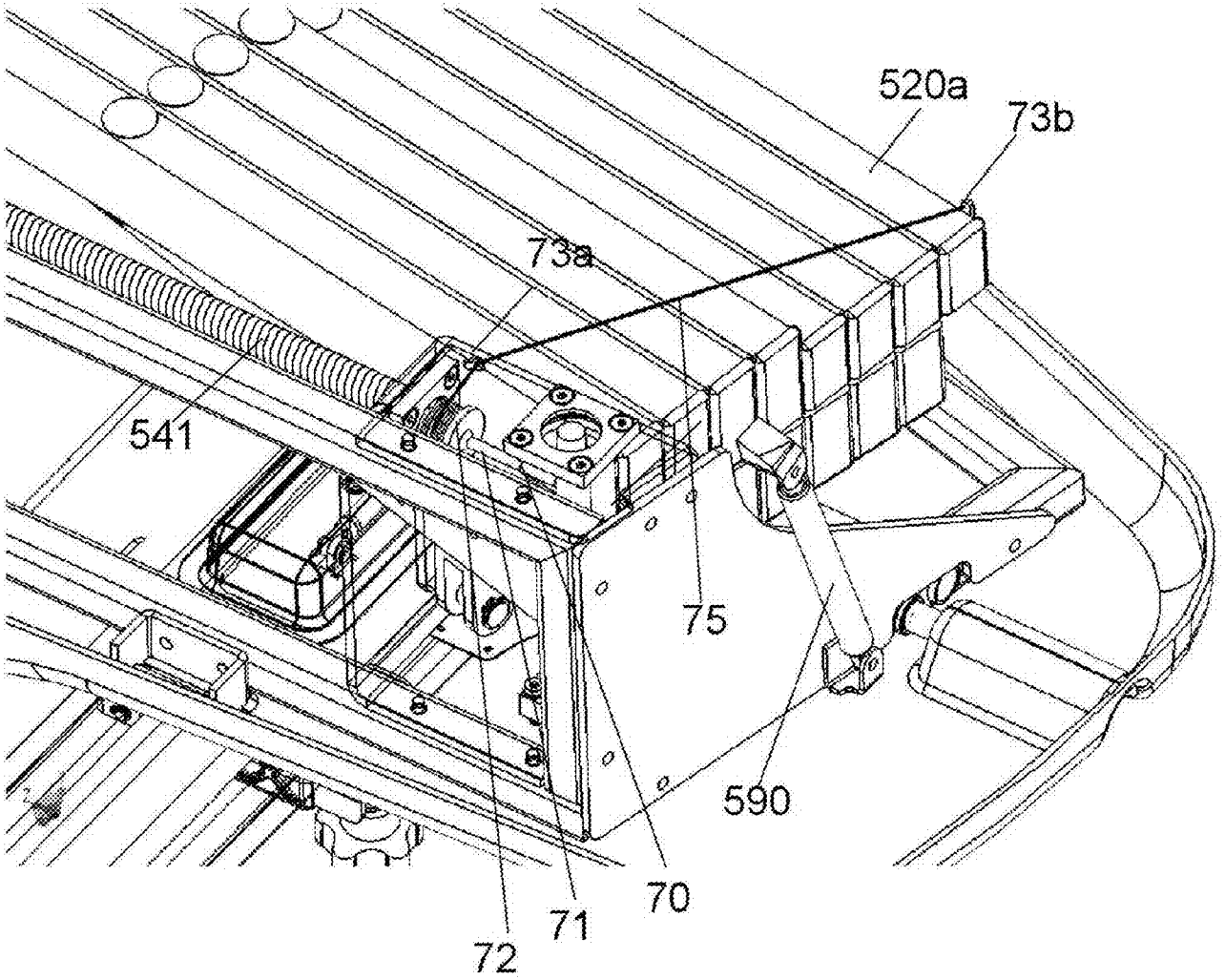
FIG. 21 shows the sheltering device having a retraction support mechanism for aiding the retraction of the supporting arms of the device to the folded position, according to some embodiments of the invention.

According to some embodiments, as illustrated in FIG. 21, each of the supporting arms 520*a* and 520*b* include an elastic strap 75 threaded therein for facilitating retraction of the respective arm 520*a*/520*b* to a folded position. The strap 75 is wrapped around a wheel 72 rotatable around an axle 71, where the axle 71 can connect to the drive shaft 541 for being rotated thereby in a manner that coordinates the rotation of the drive shaft 541 for unfolding and folding of the supporting arms 520*a* and 520*b* with the unfolding and retraction of the elastic strap 75, respectively. Each such strap 75 connects to the tip of the respective supporting arm 520*a*/520*b* through a holding member such as through a loop holder 73*b*. Another loop holder 73*a* may be used for holding the other edge of the elastic strap 75 to prevent it from tangling when retracted.

The sheltering device optionally also includes at least one of: a lift mechanism configured for lifting and optionally also tilting the sheltering device to an elevated/tilted position, allowing a user to adjust the height and optionally also the angular position of the sheltering device; and/or an expansion mechanism including at least one extendable support (e.g. telescopic rod), wherein the cover is also extendable. The extendable support may be configured to allow hanging extended cover parts thereover for enlarging surface of the cover when in an open position.

Figure 22:
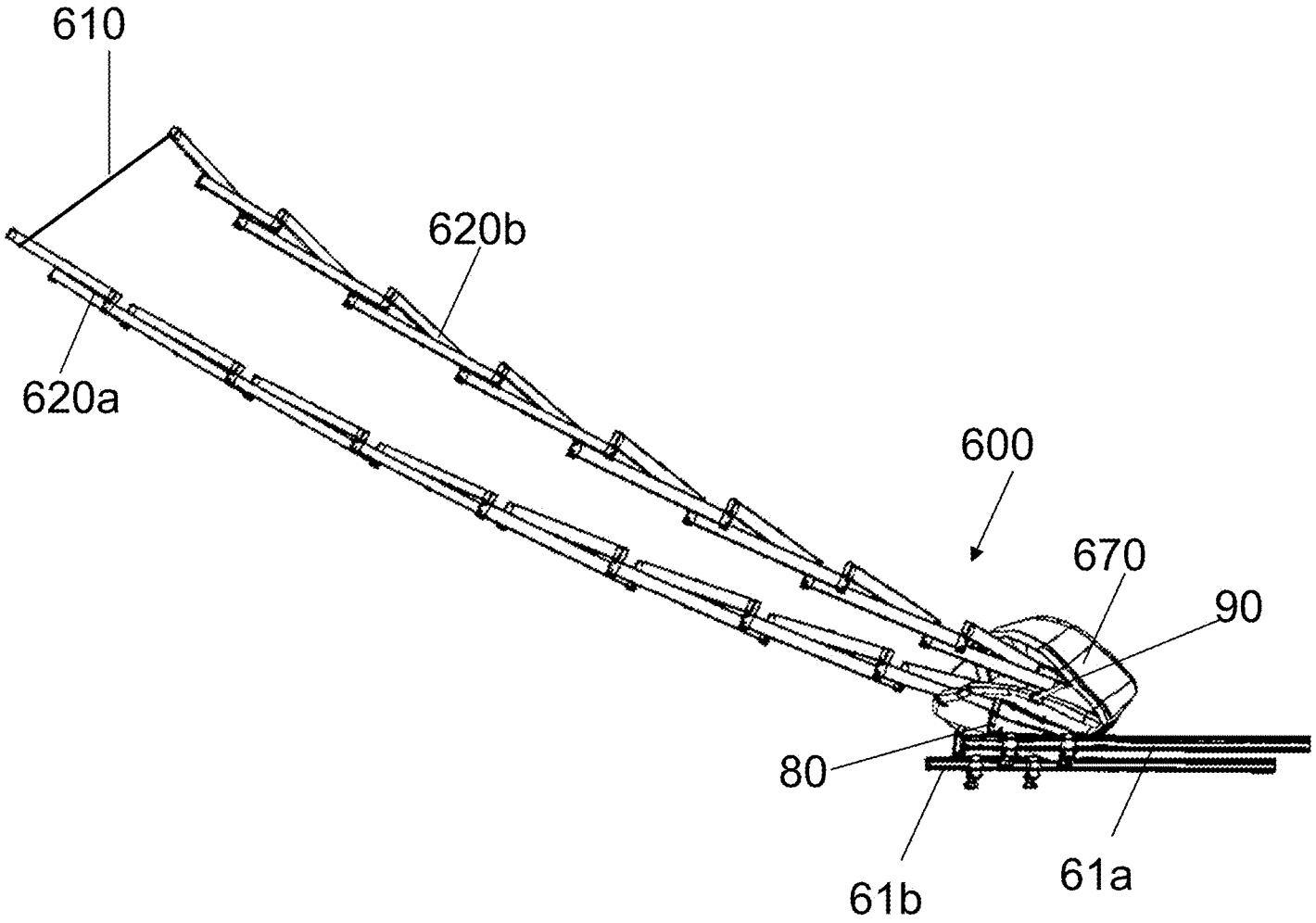
FIG. 22 shows a sheltering device including both an expansion mechanism and a lift and tilt mechanism, according to yet additional embodiments of the invention.
Figure 23:
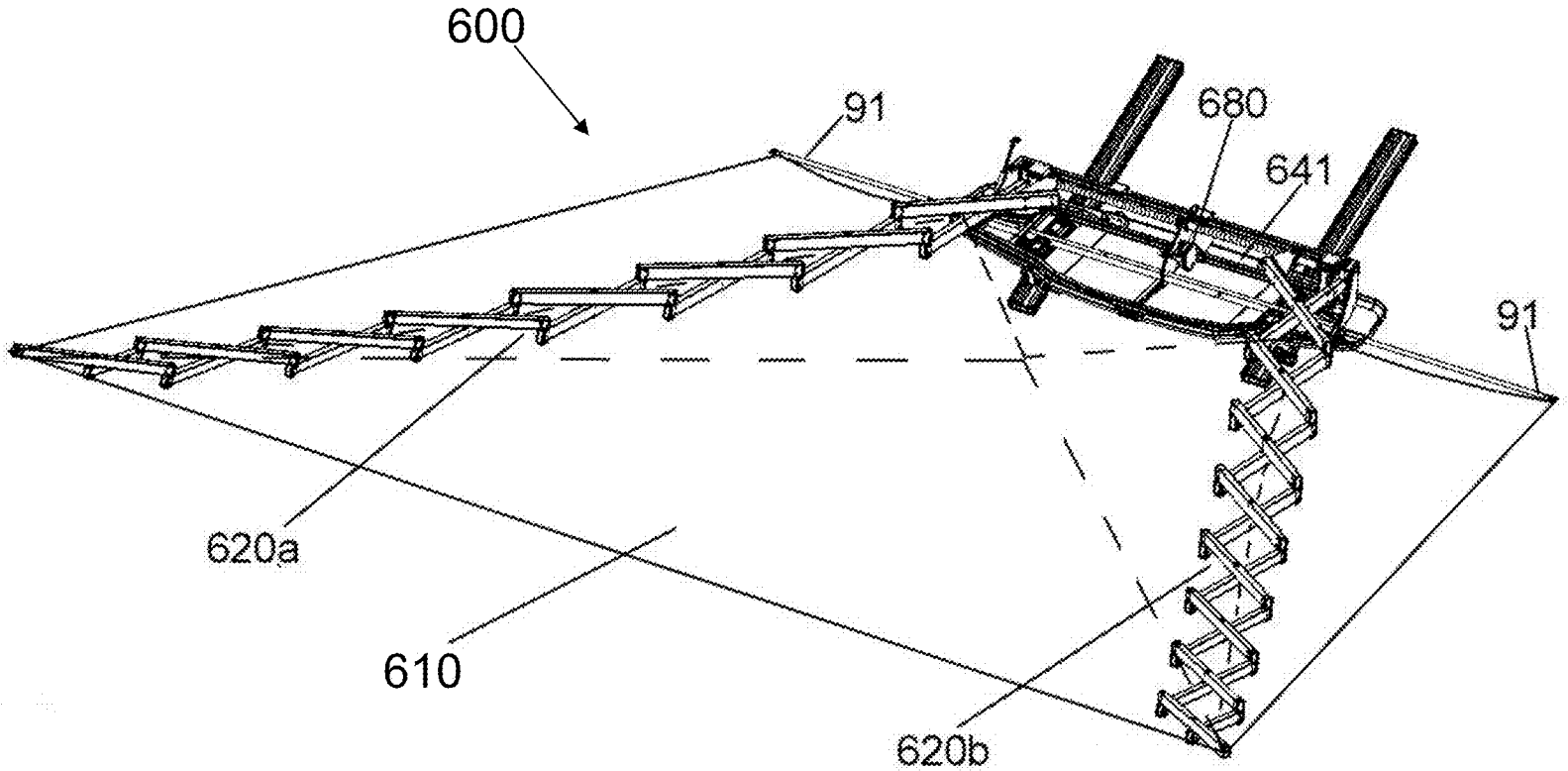
FIG. 23 shows the sheltering device as illustrated in FIG. 22 in which the supporting arms are in an open position, the lifting mechanism is in a lifted position and the expansion mechanism is in an expanded position, according to some embodiments of the invention.
Figure 24:
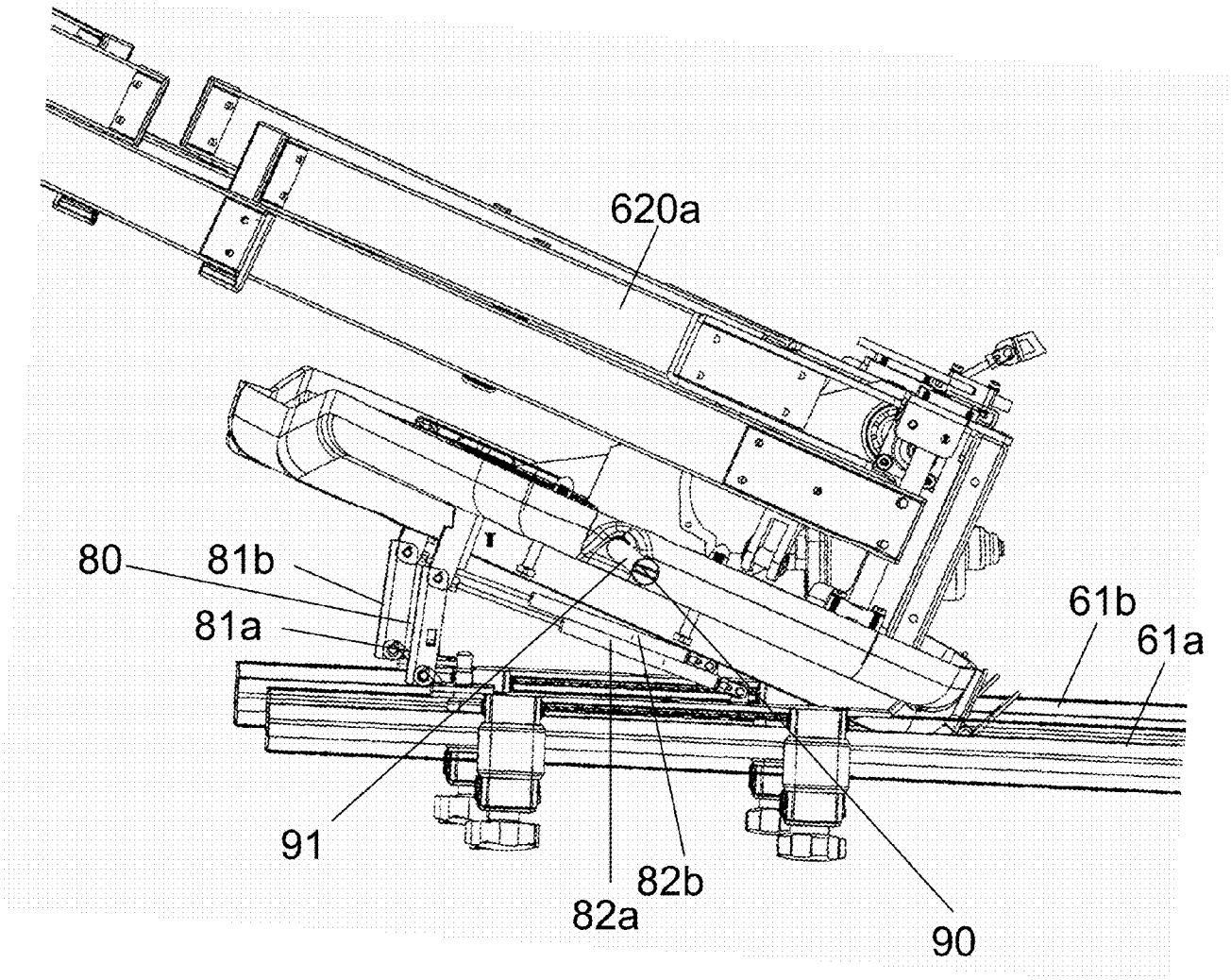
FIG. 24 shows the lifting mechanism of the sheltering device illustrated in FIGS. 22-23 in more details, according to some embodiments of the invention.

Reference is now made to FIGS. 22-24 illustrating a sheltering device 600 including both an expansion mechanism 90 and a lift and tilt mechanism 80, according to some embodiments of the invention. The supporting arms 620*a* and 620*b* of this sheltering device 600 are curved upwards in the unfolded position (as described above in respect to FIGS. 14-15) for better supporting the weight of the arms 620*a* and 620*b* and the cover 610 that is to be attached thereto.

The curving of the arms 620*a* and 620*b* is enabled by having a unique design of the hinges connecting each pair of crossing bars, which are slightly angular to the vertical axis "y" (at about 2.5 degrees, or any other small degree).

As illustrated in FIG. 23, the lift mechanism 80 allows angular lifting of the sheltering device 600 once it is fixed to a structure, by having foldable joint 81*a* and 81*b* lifted and lowered by using one or more pistons such as pistons 82*a* and 82*b* each lifting and lowering a different joint 81*a* and 81*b*, respectively. The pistons 82*a* and 82*b* may be pneumatic or include a spring therein for allowing lifting and un-lifting thereof. The lifting/tilting of the device can be either manual or electric operated.

According to some embodiments, as illustrated in FIGS. 23-24, the expansion mechanism 90 includes an extendible rod 91, which may be for example a telescopic rod 91 as shown in FIG. 23 located along an axis which is parallel to the axis defined by the drive shaft 641 operable through the transmission mechanism 680 which is similar to 580 as described above. The extensible rod 91 can be manually collapsed into a folded compact position in which it can be encased by the casing 670 of the sheltering device 600 and unfolded into an extended position as shown in FIGS. 23-24. The extendible rod 91 is designed to allow the user to enlarge the cover 610. The cover can be open to two optional open positions: a first position and a second position, where in the first position the cover is smaller in coverage surface than in the second position. This requires the cover to be semi-folded in the first position where access sections thereof are folded and may be held by the stretched open part thereof through, for example, Velcro™ fasteners and then, when the user wishes to increase the coverage surface of the cover he/she may simply extract the extendible rod 91 and unfold the cover 610 sections that were folded over the protruding tips of the extendible rod 91.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not to be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A sheltering device configured for being installed over a designated object for providing shelter in the vicinity of said object, said sheltering device comprising:

at least two foldable supporting arms, wherein each of said at least two foldable supporting arms comprises a first set of bars and a second set of bars, interconnected by hinges constructing scissor mechanism;

a single flexible cover attached to each of said at least two foldable supporting arms by at least one point; and a retractable mechanism configured to fold and unfold said at least two foldable supporting arms for folding and unfolding said single flexible cover attached thereto;

wherein a first bar of the first set of bars, which is associated with said retractable mechanism, is slightly longer than a first bar of the second set of bars, wherein each of said at least two foldable supporting arms is supported only at one proximal end thereof by the object, such that each of the at least two foldable supporting arms creates at least one stable supporting point suspended in air at a distal arm tip;

wherein said at least two foldable supporting arms are configured to simultaneously move along a two dimensional travel course, the at least two support arms moving along a first axis and a second axis respectively, the first axis and the second axis defining non-parallel trajectories such that farthermost tips of the at least two foldable supporting arms move away from one another when unfolded, to allow said single flexible cover, attached thereto to unfold in a forward and sideways movement in a two dimensional travel course throughout and according to the travel course movement of the at least two foldable supporting arms, and wherein a distance between the farthermost bar tips of said at least two foldable supporting arms is significantly larger in an unfolded state of the single flexible cover than a distance between said farthermost tips in a folded state of the single flexible cover.

2. The sheltering device of claim 1 further comprising at least one curved bar connected to one of the first set of bars or the second set of bars of the at least two foldable supporting arms, wherein the one set of bars slides along the curved bars while expanding, such that the movement of edges of the at least two foldable supporting arms is two dimensional and is restricted by the form of the at least one curved bar.

3. The sheltering device of claim 1, wherein said retractable mechanism comprises a transmission mechanism for operating said retractable mechanism, said transmission mechanism comprises a motor configured for electrically operating said sheltering device for folding and unfolding thereof by folding and unfolding said at least two foldable supporting arms.

4. The sheltering device of claim 3, wherein the retractable includes a casing encapsulating the at least two foldable supporting arms, the roller, the electronic motor and the single flexible cover in a closed position of the single flexible cover.

5. The sheltering device of claim 1, wherein the retractable mechanism includes at least one electric motor, said motors is arrange operating the roller and move the at least two foldable supporting arms forward and backward.

6. The sheltering device of claim 1, wherein the at least two foldable supporting arms have a telescopic structure comprised of plural pipes elements, wherein the at least two foldable supporting arms rotate and move in a two dimensional travel course, stretching the single flexible cover forwards and sideways.

7. The sheltering device of claim 6, wherein the trajectories of said at least two foldable supporting arms through the folding and unfolding movement thereof are curved or straight and/or crossing or uncrossing.

8. The sheltering device of claim 6, wherein the at least two foldable supporting arms are designed to be normally at an open position.

9. The sheltering device of claim 6, wherein said electronic retractable mechanism includes a pneumatic or hydraulic mechanism for moving the pipe elements in and out.

10. The sheltering device of claim 1, wherein the at least two foldable supporting arms are positioned one above the other.

11. The sheltering device of claim 1, wherein the at least two foldable supporting arms are positioned at the same height level, one beside the other.

12. The sheltering device of claim 1, wherein the cover has at least one inflatable element, and a compressor, wherein said inflatable element is filled with air when opening the cover and deflated when closing the cover.

13. The sheltering device of claim 1, wherein said transmission mechanism comprises a motor configured for rotating said drive shaft.

14. The sheltering device according to claim 1, wherein said transmission mechanism further comprises a gear set comprising multiple cogwheels configured to be rotated by said motor and to rotate said drive shaft.

15. The sheltering device of claim 14, wherein said transmission mechanism further comprises a rotatable handle rotatably connected to said gear set or directly to the drive shaft for allowing manual rotation thereof.

16. The sheltering device of claim 1 further comprising a lift mechanism configured to lift said sheltering device to an elevated position, allowing a user to adjust the height of said sheltering device.

17. The sheltering device of claim 16, wherein said lift mechanism is further configured to tilt said sheltering mechanism to allow the user to adjust both height and tilt of said sheltering device.

18. The sheltering device of claim 1, wherein said at least two supporting arms are curved upwards when unfolded.

19. The sheltering device of claim 1 further comprising an extension mechanism including at least one extendable support, wherein said single flexible cover is also extendable, said extendable support is configured to allow hanging access cover parts thereover for enlarging surface of said cover when in an open position.

20. The sheltering device of claim 1 wherein said retractable mechanism comprises a screw threaded drive shaft, at least two movable elements which have an inner threaded opening configured to rotate and move along the drive shaft, at least two connectors having a bearing, each one is rotatable over each of the movable elements, wherein the first bar of the first set of bars of each of said at least two foldable supporting arms is attached to one of said connectors, such that when the drive shaft rotates, the movable elements move along the drive shaft translating the rotational movement of the drive shaft into lateral movement of each of said supporting arm, and wherein the second set of bars of each of said at least two foldable supporting arms pivotally connects to a vertical fixed hinge for enabling and supporting folding and unfolding a respective foldable supporting arm of the second set of bars.

* * * * *